US010974514B2

(12) United States Patent
Hayashi

(10) Patent No.: US 10,974,514 B2
(45) Date of Patent: Apr. 13, 2021

(54) LIQUID CARTRIDGE INCLUDING CIRCUIT BOARD IN CONTACT WITH PROTRUSION

(71) Applicant: BROTHER KOGYO KABUSHIKI KAISHA, Nagoya (JP)

(72) Inventor: Masahiro Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/523,010

(22) Filed: Jul. 26, 2019

(65) Prior Publication Data

US 2020/0070527 A1 Mar. 5, 2020

(30) Foreign Application Priority Data

Aug. 31, 2018 (JP) ..... JP2018-162364

(51) Int. Cl.
*B41J 2/17* (2006.01)
*B41J 2/175* (2006.01)

(52) U.S. Cl.
CPC ..... *B41J 2/17523* (2013.01); *B41J 2/1753* (2013.01)

(58) Field of Classification Search
None
See application file for complete search history.

(56) References Cited

U.S. PATENT DOCUMENTS

2007/0085875 A1* 4/2007 Shimazaki ..... B41J 2/16511 347/32
2013/0162731 A1 6/2013 Takagi et al.
2014/0168324 A1* 6/2014 Sasaki ..... B41J 2/1752 347/86
2014/0354719 A1 12/2014 Yamagata et al.
2015/0367356 A1 12/2015 Gruenbacher et al.
2016/0059569 A1 3/2016 Takagi et al.
2017/0085031 A1 3/2017 Ishizawa et al.
2017/0282569 A1 10/2017 Kobayashi et al.
(Continued)

FOREIGN PATENT DOCUMENTS

EP 2 607 085 A1 6/2013
EP 3 157 586 A1 4/2017
(Continued)

OTHER PUBLICATIONS

Extended European Search Report issued in related European Patent Application No. 19183409.2, dated Dec. 5, 2019.
(Continued)

*Primary Examiner* — Erica S Lin
(74) *Attorney, Agent, or Firm* — Merchant & Gould P.C.

(57) ABSTRACT

A liquid cartridge includes: a housing defining a storage chamber therein; a liquid passage in communication with the storage chamber; and a circuit board. The liquid passage extends in a first lateral direction from the housing when the housing is in an operational posture. The circuit board includes a substrate and an electrical contact. The substrate includes a top surface, a bottom surface opposite the top surface, a front surface facing in the first lateral direction and connecting the top surface to the bottom surface, and a printer engaging surface facing in a second lateral direction opposite the first lateral direction and connecting the top surface to the bottom surface of the substrate. The electrical contact is provided on the top surface of the substrate.

15 Claims, 24 Drawing Sheets

(56) References Cited

U.S. PATENT DOCUMENTS

| | | | |
|---|---|---|---|
| 2018/0178534 | A1 | 6/2018 | Nukui et al. |
| 2018/0244061 | A1 | 8/2018 | Hayashi et al. |
| 2018/0281438 | A1 | 10/2018 | Horade et al. |

FOREIGN PATENT DOCUMENTS

| | | | |
|---|---|---|---|
| JP | 2016-185651 | A | 10/2016 |
| JP | 2017-52220 | A | 3/2017 |
| JP | 2017-56706 | A | 3/2017 |
| JP | 2018-171845 | A | 11/2018 |

OTHER PUBLICATIONS

Written Opinion issued in related International Patent Application No. PCT/JP2018/042444, dated Jan. 22, 2019.
International Search Report issued in related International Patent Application No. PCT/JP2018/042444, dated Jan. 22, 2019.

* cited by examiner

LIQUID CARTRIDGE INCLUDING CIRCUIT BOARD IN CONTACT WITH PROTRUSION

CROSS REFERENCE TO RELATED APPLICATION

This application claims priority from Japanese Patent Application No. 2018-162364 filed Aug. 31, 2018. The entire content of the priority application is incorporated herein by reference.

TECHNICAL FIELD

The present disclosure relates to a system including a liquid cartridge storing liquid therein and an attachment section to which the liquid cartridge is attachable.

BACKGROUND

There is conventionally known a system including an ink cartridge, and an inkjet recording device. The inkjet recording device includes an attachment section, and the ink cartridge can be mounted in and extracted from the attachment section. The attachment section of the inkjet recording device includes contacts and an engaging section engageable with the ink cartridge.

There is also known an ink cartridge provided with a circuit board (for example, see Japanese Patent Application Publication No. 2017-056706). A memory is mounted on the circuit board for storing information such as a color, a material composition, and an amount of ink stored in the cartridge. Electrodes are also formed on the circuit board. Electrical connections are established between the electrodes on the ink cartridge and the contacts of the attachment section when the ink cartridge is mounted in the attachment section, so that the inkjet recording device can read the information stored in the memory.

A conventional ink cartridge may also include an engaging surface engageable with an engaging section of the attachment section. In a printer of the above publication, a lever is provided in the attachment section. This lever is pushed downward to engage with the ink cartridge so that the ink cartridge is prevented from coming out of the attachment section.

SUMMARY

However, in the printer disclosed in the above publication, the circuit board is provided at a front end of the ink cartridge (i.e., a far side of the attachment section), whereas a lock portion (engageable with the lever) is provided at a rear end portion of the ink cartridge (i.e., a near side of the attachment section). That is, the circuit board and the lock portion are arranged to be remote from each other.

In the above structure, due to dimensional errors of parts constituting the lock portion and the lever, the electrodes on the circuit board may deviate in position relative to contacts of the attachment section and may not be positioned stably. Further, deviation in position of the lock portion relative to the lever in a state where the liquid cartridge is attached to the attachment section may result in deviation in position of the electrodes relative to the contacts of the attachment section.

Further, in the above-disclosed construction where the position of the circuit board is far away from the position of the lock portion, as the difference in the dimensional tolerance of the parts becomes larger, the larger deviation in position of the circuit board may result. Likewise, as the position of the lock portion deviates larger relative to the lever, the deviation in position of the circuit board may also become larger. As a result, the electrical connection between the electrodes on the circuit board and the contacts may be likely to become unstable.

In view of the foregoing, it is an object of the present disclosure to provide a system capable of providing accurate positioning of a circuit board and maintaining the position of the circuit board reliably.

In order to attain the above and other objects, according to one aspect, the present disclosure provides a liquid cartridge including a housing, a liquid passage and a circuit board. The housing defines a storage chamber configured for storing liquid therein. The liquid passage extends in a first lateral direction from the housing when the housing is in an operational posture, and the liquid passage is in communication with the storage chamber. The circuit board includes a substrate and an electrical contact. The substrate has a top surface, a bottom surface opposite the top surface, a front surface facing in the front lateral direction and connecting the top surface to the bottom surface, and a printer engaging surface facing in a second lateral direction opposite the first lateral direction and connecting the top surface to the bottom surface. The electrical contact is provided on the top surface.

According to another aspect, the present disclosure also provides a liquid cartridge including a housing, a liquid passage, a circuit board, and a protrusion. The housing defines a storage chamber configured for storing liquid therein. The liquid passage extends in a first lateral direction from the housing when the housing is in an operational posture. The liquid passage is in communication with the storage chamber. The circuit board includes a substrate and an electrical contact. The substrate has a top surface, a bottom surface opposite the top surface, a front surface facing in the first lateral direction and connecting the top surface to the bottom surface, and a rear surface facing in a second lateral direction opposite the first lateral direction and connecting the top surface to the bottom surface. The electrical contact is provided on the top surface. The protrusion protrudes upward from the housing. The protrusion is in contact with the rear surface of the substrate. The protrusion has a printer engaging surface facing in the second lateral direction.

According to still another aspect, the present disclosure also provides a liquid cartridge including a housing, a liquid passage, a protrusion and a circuit board. The housing defines a storage chamber configured for storing liquid therein. The housing includes: a front wall facing in a first lateral direction when the housing is in an operational posture; a rear wall positioned opposite to the front wall with respect to the storage chamber; and a top wall connecting the front wall to the rear wall and positioned upward of the storage chamber. The top wall is formed with a through-hole penetrating therethrough vertically. The liquid passage extends in the first lateral direction through the front wall and is in communication with the storage chamber. The protrusion protrudes upward from the top wall. The protrusion has a top surface facing upward, and a rear surface facing in a second lateral direction opposite the first lateral direction. The circuit board includes a flexible substrate, and an electrical contact facing upward. The flexible substrate penetrates the top wall vertically through the through-hole and extends to cover the top surface of the protrusion. The electrical contact is formed on a portion of the flexible substrate covering the top surface of the protrusion.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
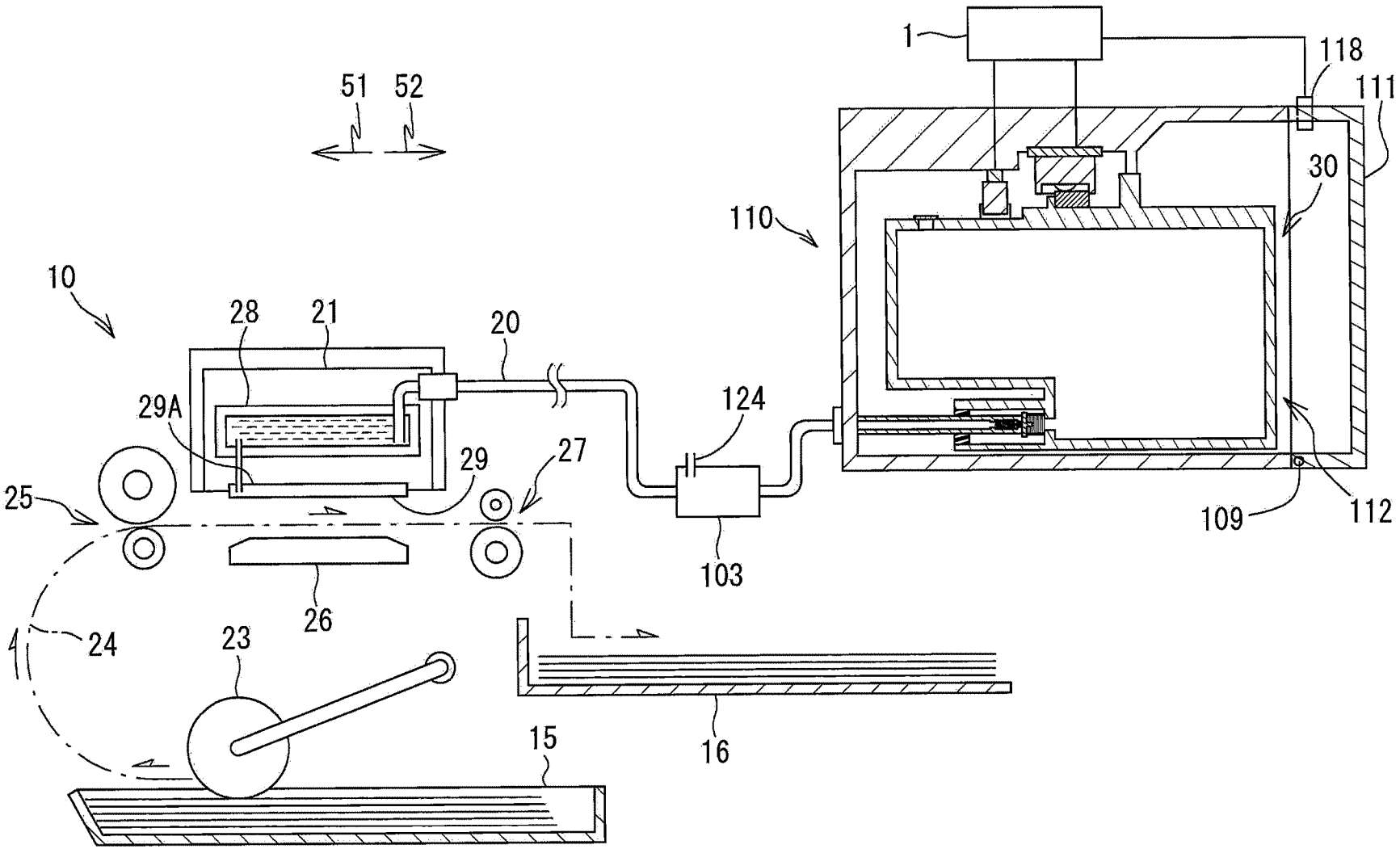
FIG. 1 is a vertical cross-sectional diagram schematically illustrating an internal structure of a printer according to one embodiment of the disclosure.

FIG. 1 illustrates a printer 10 according to one embodiment of the disclosure. The printer 10 is configured to record images on sheets of paper based on an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the cartridge-attachment section 110 of the printer 10 constitute a system of the present disclosure.

Figure 9:
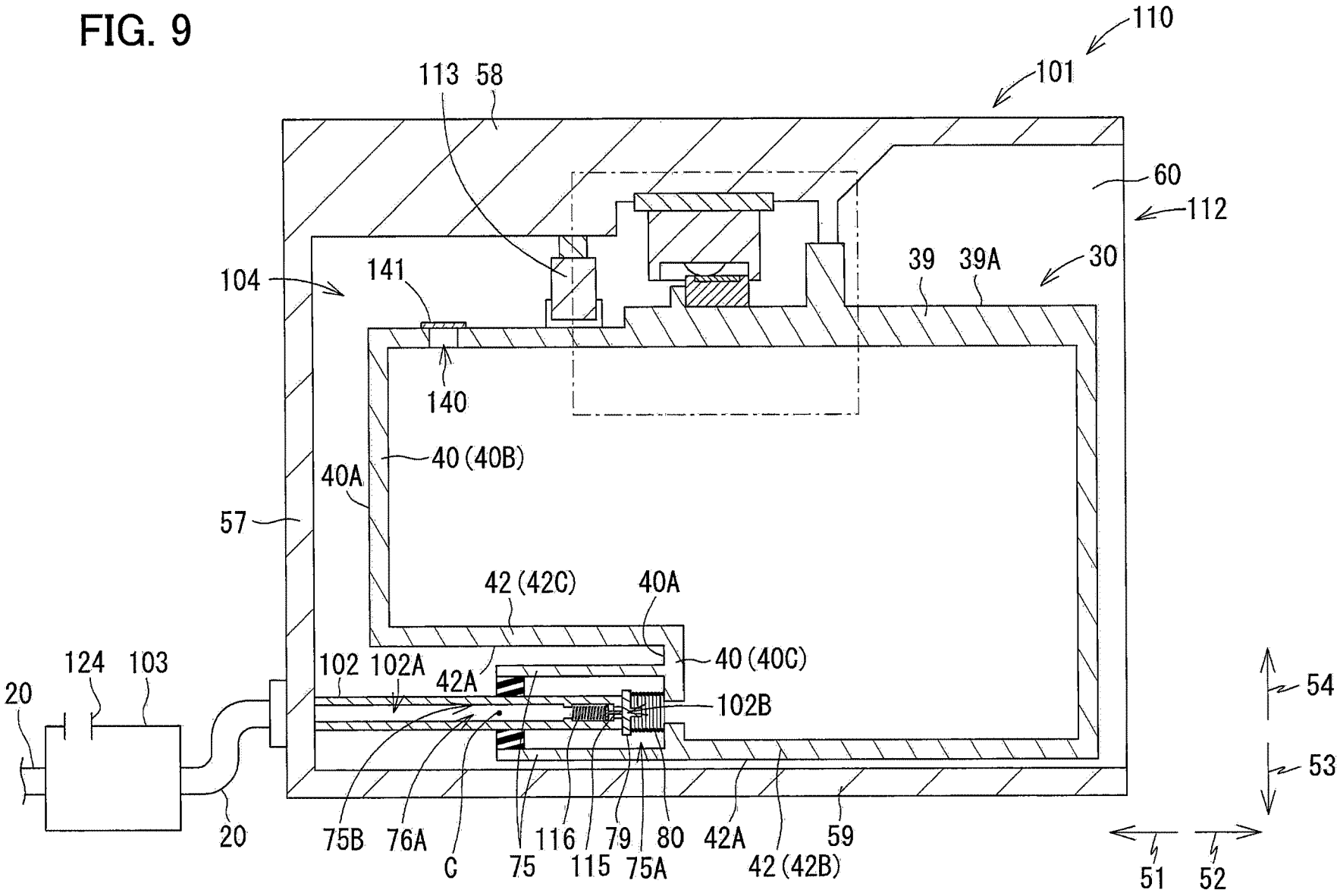
FIG. 9 is a vertical cross-sectional view illustrating a state where the ink cartridge according to the embodiment is attached to the cartridge-attachment section.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 shows one of the ink cartridges 30 in its attached state in the cartridge-attachment portion 110, i.e., in a state where the ink cartridge 30 has been completely attached to the cartridge-attachment portion 110. FIG. 9 shows the ink cartridge 30 and cartridge-attachment portion 110 of FIG. 1. That is, FIG. 9 shows the attached state of the ink cartridge 30.

Figure 4:
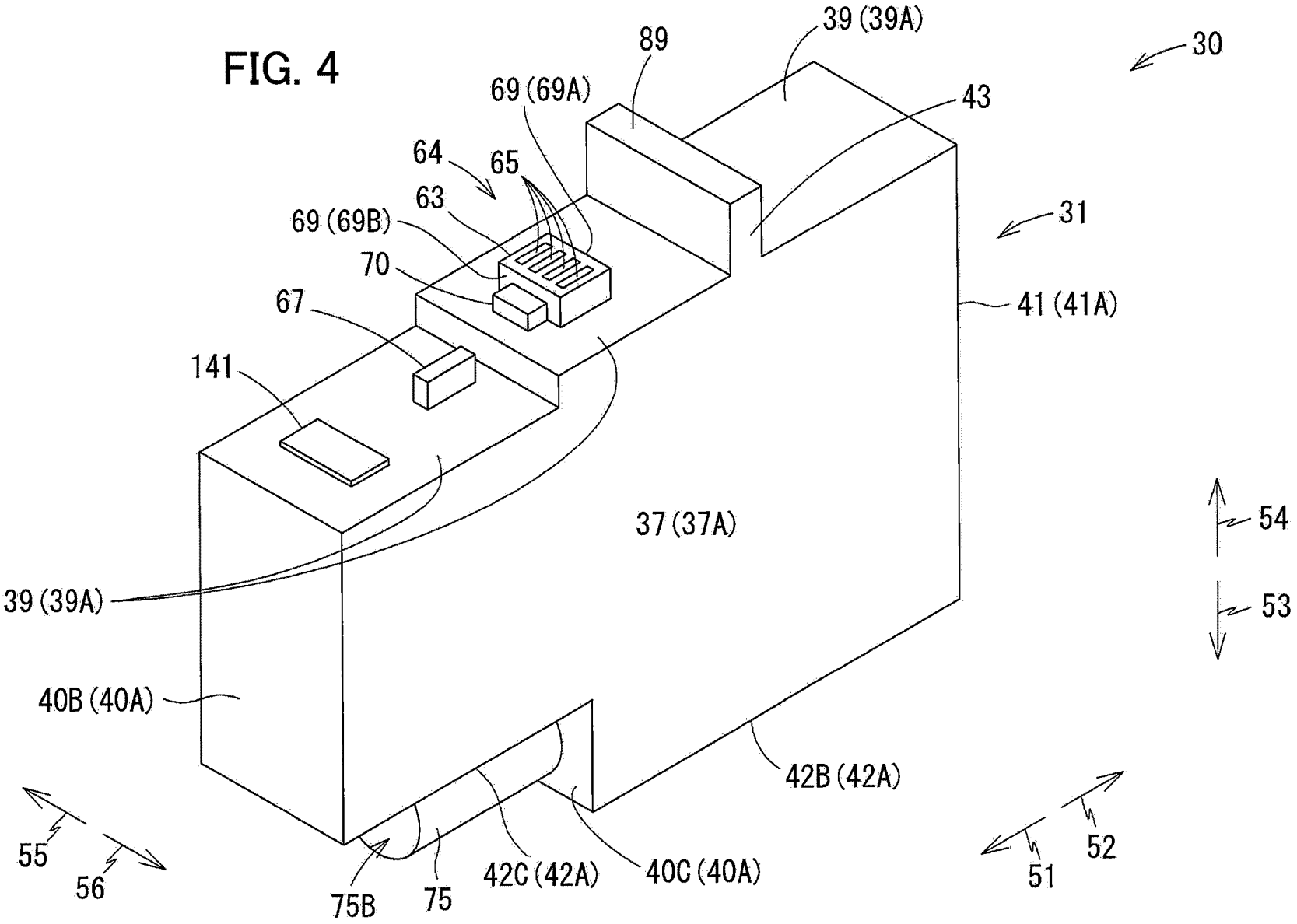
FIG. 4 is a perspective view of an ink cartridge according to the embodiment in an upright posture thereof.

In the following description, a direction in which the ink cartridge 30 is inserted into the cartridge-attachment portion 110 is defined as a frontward direction 51. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1, 4-10 (and 13-24) illustrate the ink cartridge 30 in this upright posture. A rearward direction 52 is defined as a direction opposite the frontward direction 51, and is a direction in which the ink cartridge 30 is extracted from the cartridge-attachment portion 110. In the present embodiment, a horizontal direction is defined as a direction orthogonal to a direction of gravity and parallel to the insertion direction. Both the frontward direction 51 and rearward direction 52 are parallel to the horizontal direction (direction orthogonal to the direction of gravity). The frontward direction 51 and rearward direction 52 cross the direction of gravity. Further, a downward direction 53 is defined as the direction of gravity, and an upward direction 54 is defined as a direction opposite the direction of gravity. Further, as shown in FIGS. 4, 6A and 6B, directions orthogonal to the frontward direction 51 and downward direction 53 are defined as a rightward direction 55 and a leftward direction 56, respectively. More specifically, when the ink cartridge 30 is in its upright posture (the attached state shown in FIG. 1), the rightward direction 55 is defined as a direction extending rightward and the leftward direction 56 as a direction extending leftward when the ink cartridge 30 is viewed from the rear, as illustrated in FIG. 6A.

Further, in the following description, the frontward direction 51 and rearward direction 52 will be collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the vertical direction (i.e., height direction); a depth in the front-rear direction (i.e., depth direction); and a width in the left-right direction (i.e., widthwise direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

The ink cartridge 30 is inserted forward into the cartridge-attachment portion 110 through the opening 112 (see FIGS. 7 and 8) while being in the upright posture, and is attached to the cartridge-attachment portion 110 (see FIG. 9). The ink cartridge 30 is extracted rearward from the cartridge-attachment portion 110 while being in the upright posture.

Each ink cartridge 30 stores ink that the printer 10 can use for printing. As shown in FIG. 1, each ink cartridge 30 is connected to the recording head 21 by the corresponding ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not shown), and piezoelectric elements 29A corresponding one-on-one to the nozzles 29. The head control board selectively applies drive voltages to the piezoelectric elements 29A in order to eject ink from the nozzles 29.

In the attached state of the ink cartridges 30 to the cartridge-attachment portion 110, the ink in each ink cartridge 30 can be used for printing by the recording head 21 in the printer 10. Hence, hereinafter, the posture of each ink cartridge 30 in its attached state to the cartridge-attachment portion 110 may also be called as "operational posture", as appropriate.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet onto the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on a downstream end of the conveying path 24.

<Cartridge-Attachment Portion 110>

Figure 2:
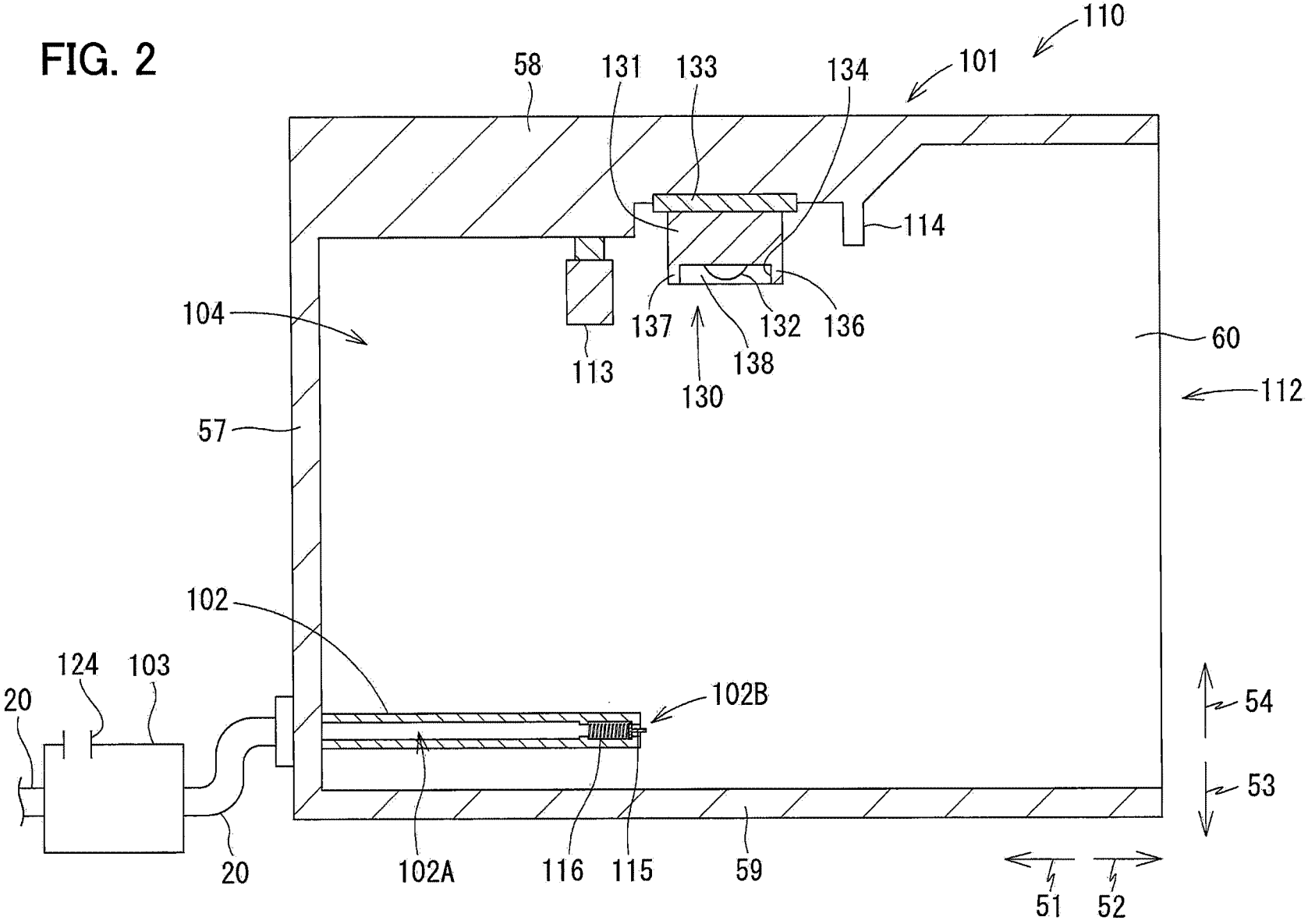
FIG. 2 is a vertical cross-sectional view of a cartridge-attachment section of the printer according to the embodiment.

As shown in FIG. 2, the cartridge-attachment portion 110 includes a cartridge holder 101, a cover 111, a cover sensor 118, and four sets of tubes 102, tanks 103, optical sensors 113, protruding parts 114, and connectors 130.

<Cartridge Holder 101>

The cartridge holder 101 shown in FIG. 2 constitutes a housing of the cartridge-attachment portion 110. The cartridge holder 101 has a box shape. An interior space 104 is formed inside the cartridge holder 101.

As shown in FIG. 2, the cartridge holder 101 includes an end wall 57, a bottom wall 59, a top wall 58, and a pair of side walls 60. The bottom wall 59 extends rearward from a bottom edge of the end wall 57. The top wall 58 extends rearward from a top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 are separated from each other in the left-right direction and respectively connect the top wall 58 to the bottom wall 59.

An end of the cartridge holder 101 opposite the end wall 57 in the front-rear direction is open and serves as the opening 112. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not shown) partition the interior space 104 into four compartments. One each of the tubes 102, tanks 103, optical sensors 113, protruding parts 114, and connector 130 is provided in each compartment of the interior space 104. Note that the number of compartments in the interior space 104 is not limited to four.

<Cover 111>

As shown in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Cover Sensor 118>

As shown in FIG. 1, the cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to a controller 1

(see FIG. 1). When the cover 111 is not in the closed position, that is, when the cover 111 is separated from the cover sensor 118, the cover 111 does not interrupt the light traveling from the light-emitting part to the light-receiving part. The cover sensor 118 thus outputs a high level signal to the controller 1.

<Tubes 102>

Each tube 102 shown in FIG. 2 is a hollow cylindrically shaped member formed of a resin. As shown in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

Each tube 102 has an interior space 102A therein. A valve 115 and a coil spring 116 are accommodated in each interior space 102A. By moving in the front-rear direction, the valve 115 opens and closes an opening 102B formed in the distal end of the tube 102. The coil spring 116 urges the valve 115 rearward. Hence, in a state where no external force is applied to the valve 115 (when the ink cartridge 30 is not mounted in the cartridge-attachment portion 110), the valve 115 closes the opening 102B. When no external force is applied to the valve 115, a rear end of the valve 115 urged by the coil spring 116 protrudes out of the opening 102B to extend further rearward than the opening 102B.

Notches (not shown) are formed in a peripheral wall of each tube 102 at a distal end thereof, and specifically in a portion of the peripheral wall positioned rearward from a part of the valve 115 that closes the opening 102B, i.e., a front end of the valve 115.

<Tanks 103>

As shown in FIG. 2, the tanks 103 are provided frontward of the cartridge holder 101. Each tank 103 has a box shape that allows ink to be stored therein. Each tank 103 has a top portion that is open to the outside through an air communication port 124. Accordingly, an interior space of the tank 103 is in communication with the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 through the corresponding ink tube 20. Accordingly, ink stored in the internal space of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As shown in FIG. 2, the optical sensors 113 are disposed near the top wall 58 of the cartridge holder 101. Each optical sensor 113 includes a light-emitting part and a light-receiving part. The light-emitting part is disposed on the right or left of the light-receiving part and is spaced away from the light-receiving part.

The optical sensors 113 are configured to output detection signals to the controller 1. The signals differ depending on whether the light-receiving parts receive light emitted from the corresponding light-emitting parts. For example, the optical sensor 113 may output a low level signal to the controller 1 when the light-receiving part cannot receive light emitted from the corresponding light-emitting part (that is, when the received light is less than a prescribed intensity); and the optical sensor 113 may output a high level signal to the controller 1 when the light-receiving part can receive light emitted from the corresponding light-emitting part (that is, when the received light is greater than or equal to the prescribed intensity). Here, the controller 1 is a device for controlling overall operations of the printer 10 and is configured of a CPU, ROM, and RAM, for example.

<Protruding Parts 114>

As shown in FIG. 2, the protruding parts 114 protrude downward from the top wall 58 of the cartridge holder 101. The protruding parts 114 are disposed rearward of the optical sensors 113 in the front-rear direction.

<Connectors 130>

Figure 3A:
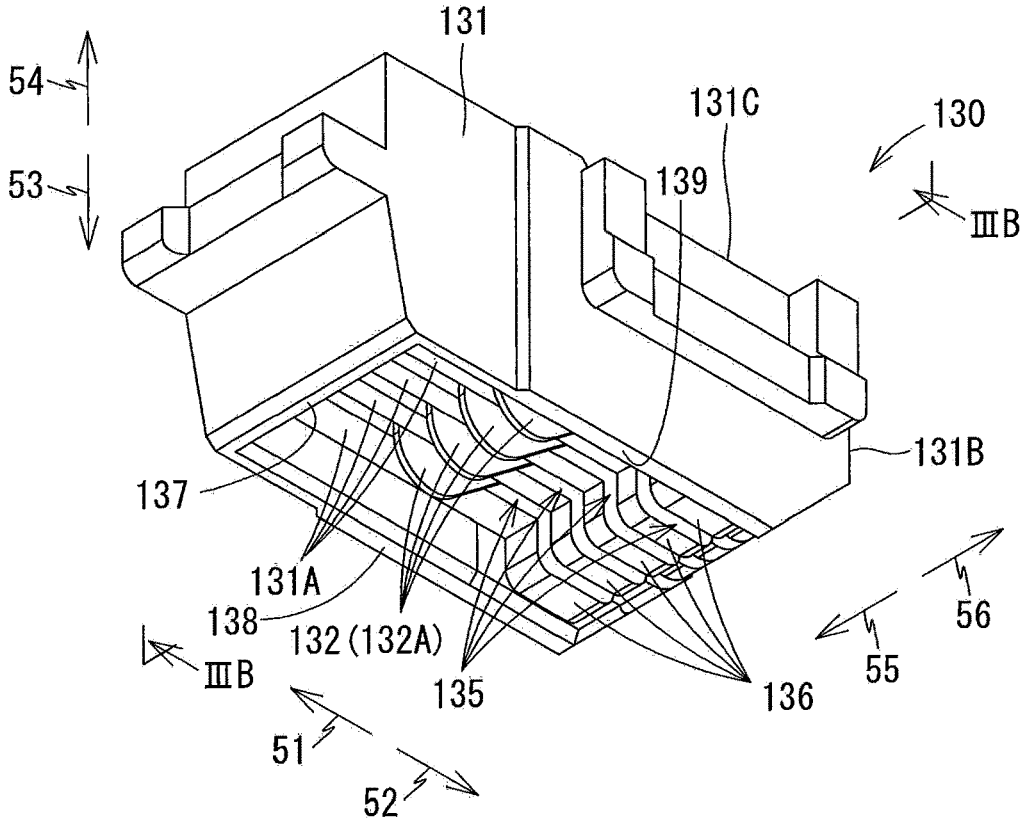
FIG. 3A is a perspective view of a connector of the cartridge-attachment section according to the embodiment.
Figure 3B:
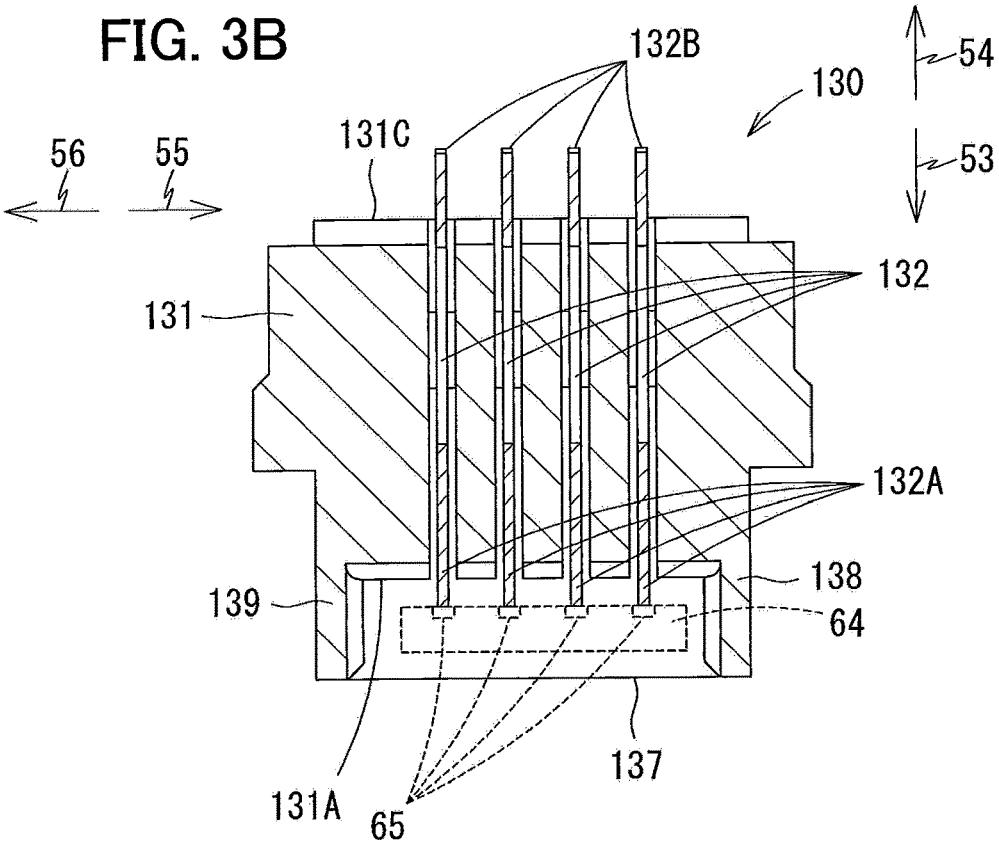
FIG. 3B is a cross-sectional view of the connector according to the embodiment taken along a plane IIIB-IIIB shown in FIG. 3A.

As shown in FIGS. 2 through 3B, each connector 130 includes four contacts 132, and a case 131 accommodating the contacts 132.

As shown in FIG. 2, a circuit board 133 is fixed to the cartridge holder 101 near the top wall 58. The circuit board 133 is positioned farther rearward than the tubes 102 and optical sensors 113 and farther forward than the protruding parts 114. The circuit board 133 is fixed to the cartridge holder 101. The cases 131 of the connectors 130 are fixed to a bottom surface of the circuit board 133 with screws, solder, or the like (not shown). Hence, the connectors 130 are fixed to the cartridge holder 101 via the circuit board 133. Note that the connectors 130 need not be fixed to the cartridge holder 101, but may be detachably attached to the cartridge holder 101.

As shown in FIGS. 3A and 3B, the case 131 of each connector 130 has a generally rectangular parallelepiped shape. Slots 135 are formed in the case 131 from a bottom surface 131A to a top surface 131C via a rear surface 131B. Four of the slots 135 are formed at intervals in the left-right direction. The four slots 135 provide four internal spaces in the case 131. One each of the contacts 132 is disposed in each of the four internal spaces. Thus, the connector 130 includes four contacts 132. Note that the number of slots 135 is not limited to four, and thus the number of contacts 132 provided in the connector 130 is not limited to four, either.

The contacts 132 are supported by the case 131 in the corresponding internal spaces formed by the slots 135. The contacts 132 are configured of members that are flexible and electrically conductive. Bottom end portions 132A of the contacts 132 protrude farther downward than the bottom surface 131A of the case 131. The bottom end portions 132A of the contacts 132 are resiliently deformable upward.

Top end portions 132B of the contacts 132 (see FIG. 3B) are mounted on the circuit board 133. Through this construction, the contacts 132 are electrically connected to an electrical circuit mounted on the circuit board 133. In other words, the contacts 132 are electrically connected to the electrical circuit. The electrical circuit is also electrically connected to the controller 1 (see FIG. 1).

The case 131 includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are positioned lower than bottom edges of the contacts 132.

The rear wall 136 is positioned farther rearward than the bottom end portions 132A of the contacts 132. The front wall 137 is positioned farther forward than the bottom end portions 132A of the contacts 132. The rear wall 136 and front wall 137 are aligned with each other in the front-rear direction. The right wall 138 is positioned farther rightward than the bottom end portions 132A of the contacts 132, and the left wall 139 is positioned farther leftward than the bottom end portions 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

The ink cartridge 30 shown in FIGS. 4 to 6B is a container for storing ink. One ink cartridge 30 can be accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors of cyan, magenta, yellow, and black. Ink in one of these four colors is stored in the corresponding ink cartridge 30. The number of ink cartridges 30 that the cartridge-attachment portion 110 can accommodate is not limited to four.

Unless otherwise specified, hereinafter, the ink cartridge 30 is assumed to be in its upright posture (operational posture). In other words, the vertical, front-rear, and left-right directions for the ink cartridge 30 are defined based on the ink cartridge 30 being in the upright posture (operational posture).

As shown in FIGS. 4 to 6B, each ink cartridge 30 includes a housing 31, a sealing member 76, a protruding part 43, a projection 67, a raised portion 70, and a circuit board 64.

<Housing 31>

The housing 31 is configured of a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. That is, the top wall 39 and bottom wall 42 respectively connect the front wall 40 to the rear wall 41. The top wall 39 and bottom wall 42 are spaced away from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42, respectively.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in the upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface of the front wall 40B and a front surface of the front wall 40C constitute the front surface 40A of the front wall 40.

The bottom wall 42 is configured of a bottom wall 42B, and a bottom wall 42C positioned higher than the bottom wall 42B. A bottom surface of the bottom wall 42B and a bottom surface of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C.

The ink cartridge 30 has an overall flattened shape in which a left-right dimension thereof (width) is smaller than a front-rear dimension thereof (depth), and the vertical and front-rear dimensions (height and depth) are greater than the left-right dimension (width).

The ink cartridge 30 is configured to be attached to the cartridge holder 101 by inserting the ink cartridge 30 forward through the opening 112 formed in the cartridge holder 101 of the cartridge-attachment portion 110. The ink cartridge 30 is configured to be removed from the cartridge holder 101 by pulling the ink cartridge 30 rearward through the opening 112.

Figure 5:
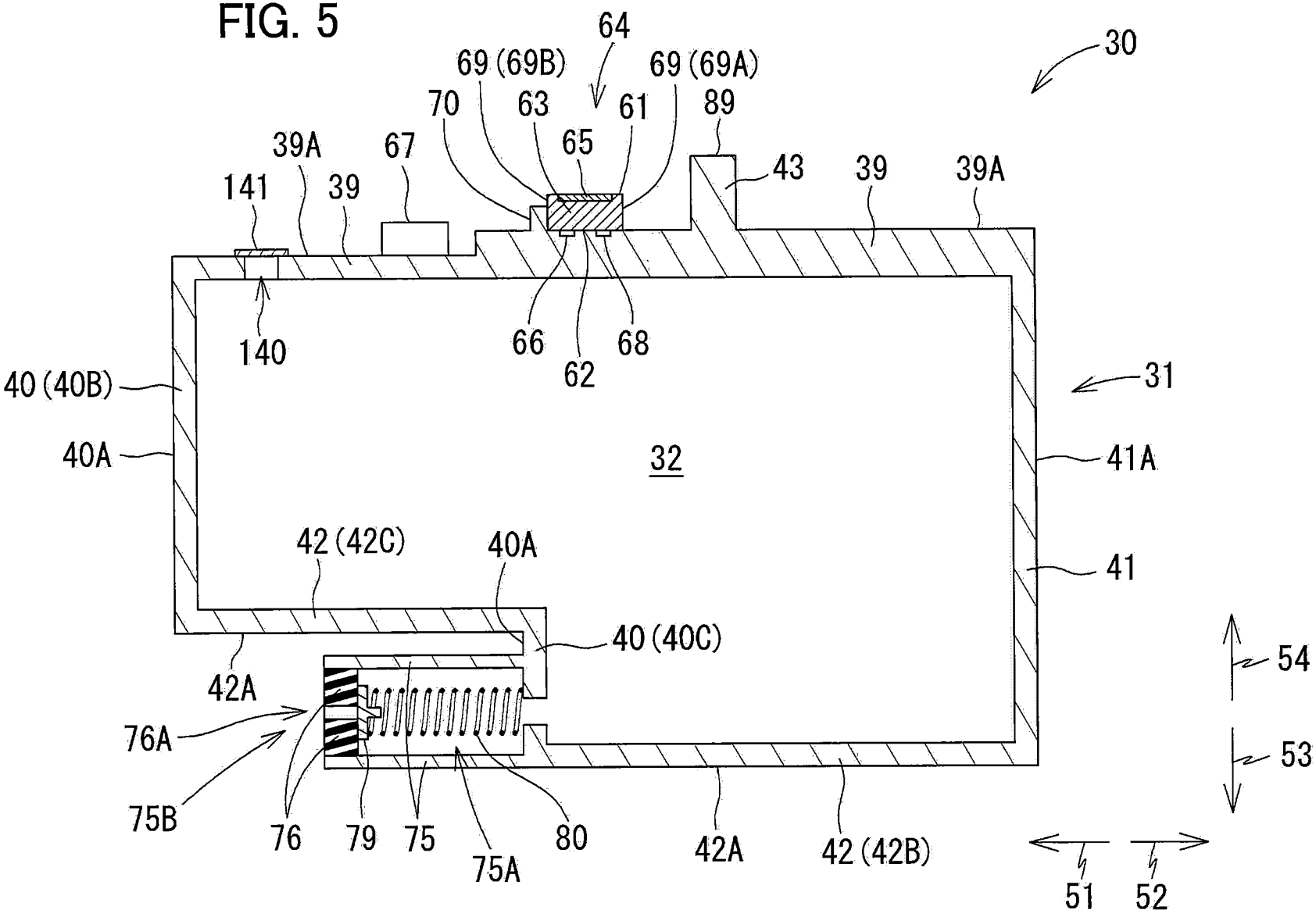
FIG. 5 is a vertical cross-sectional view of the ink cartridge according to the embodiment in the upright posture.
Figure 6B:
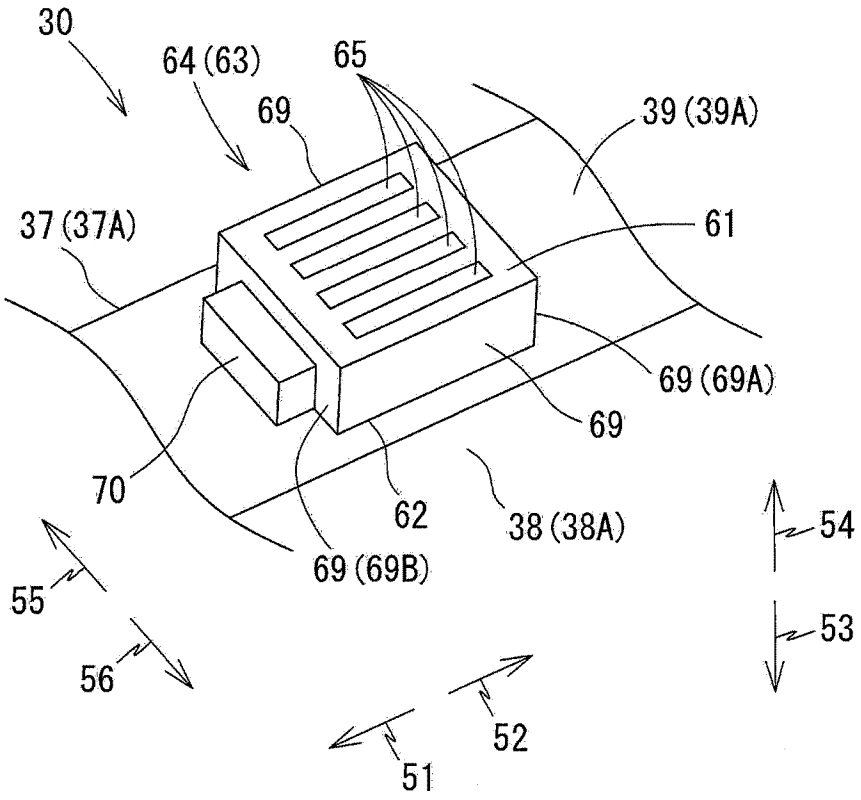
FIG. 6B is a perspective view illustrating a structure in the vicinity of a circuit board of the ink cartridge according to the embodiment in the upright posture.
Figure 6A:
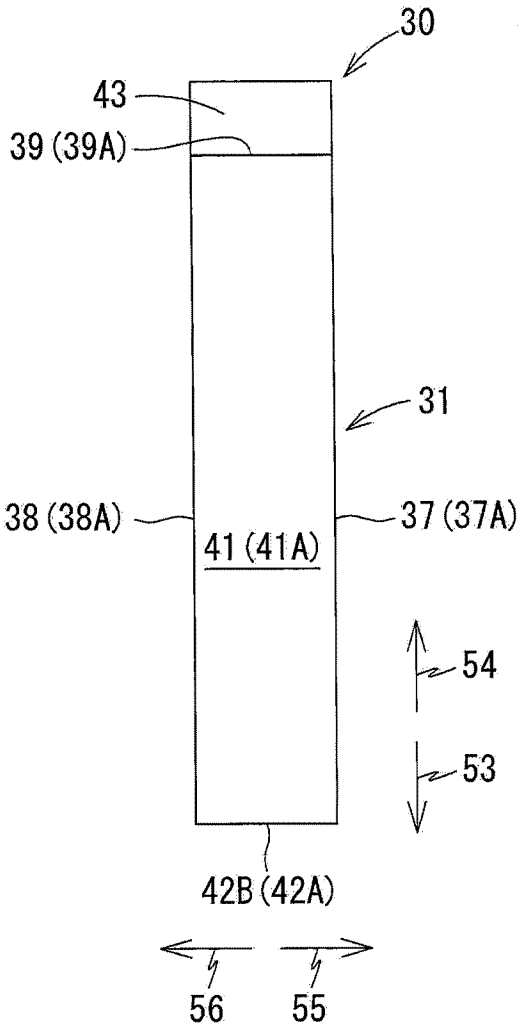
FIG. 6A is a rear side view of the ink cartridge according to the embodiment in the upright posture.

As shown in FIG. 5, the housing 31 defines therein a storage chamber 32 for storing ink. The storage chamber 32 is positioned between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (a rear surface of the front wall 40), a surface of the rear wall 41 opposite the rear surface 41A (a front surface of the rear wall 41), a surface of the top wall 39 opposite the top surface 39A (a lower surface of the top wall 39), a surface of the bottom wall 42 opposite the bottom surface 42A (an upper surface of the bottom wall 42), a surface of the side wall 37 opposite the right surface 37A (a left surface of the side wall 37), and a surface of the side wall 38 opposite the left surface 38A (a right surface of the side wall 38).

In the housing 31, at least the rear wall 41 is capable of transmitting light so that a level of ink stored in the storage chamber 32 is visible from the outside of the housing 31.

The housing 31 also includes a cylinder 75 that protrudes forward from the front surface 40A of the front wall 40C. The cylinder 75 extends in the front-rear direction. The cylinder 75 defines therein a passage 75A extending in the front-rear direction. That is, the direction in which the cylinder 75 and passage 75A extend from the housing 31 (i.e., the frontward direction 51) coincides with the insertion direction of the ink cartridge 30. An opening 75B is formed in a front end of the cylinder 75 and in communication with the passage 75A. The passage 75A has a rear end in communication with the storage chamber 32. That is, the passage 75A is provided at the front wall 40C to be open frontward. In other words, the passage 75A penetrates through the front wall 40 in the front-rear direction and provides communication between the storage chamber 32 and the outside of the housing 31.

The passage 75A accommodates therein a valve 79, and a coil spring 80. The valve 79 is movable in the front-rear direction to open and close the opening 75B. The coil spring 80 urges the valve 79 frontward. Therefore, in a state where no external force is applied to the valve 79, the valve 79 firmly contacts the sealing member 76 fitted in the opening 75B. When an external force is applied to the valve 79, the valve 79 is separated from the sealing member 76, thereby allowing ink stored in the storage chamber 32 to be supplied to the outside of the housing 31, through the passage 75A and the opening 75B. Incidentally, a structure for switching between opening and closing of the opening 75B is not limited to the structure configured of the valve 79. For example, the opening 75B may be closed by a seal affixed to the cylinder 75.

An air communication port 140 is formed in the top wall 39 of the housing 31. A seal 141 seals the air communication port 140 prior to insertion of the ink cartridge 30 into the cartridge-attachment portion 110. The seal 141 can be peeled off the air communication port 140. By peeling the seal 141 off the air communication port 140 before insertion of the ink cartridge 30 into the cartridge-attachment portion 110, the storage chamber 32 is able to communicate with an ambient air via the air communication port 140.

Incidentally, the storage chamber 32 may be communicated with the ambient air through means not involving peeling off of the seal 141. For example, a valve may be provided in the air communication port 140 so as to realize switching of a status of the storage chamber 32 between a communication state in communication with the ambient air and a non-communication state out of communication with the ambient air.

Incidentally, the front wall 40, rear wall 41, top wall 39, bottom wall 42, and side walls 37 and 38 each may be configured of a plurality of walls in the same manner as the front wall 40 in the embodiment, or each may be configured of a single wall just like the rear wall 41.

Still alternatively, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces, respectively.

The front surface 40A of the front wall 40 is a surface of the housing 31 that the user can see when the ink cartridge 30 in its upright posture is viewed from the front side. According to a concept of the present disclosure, a front surface includes: a surface of the housing 31 positioned farthest forward (the front surface 40A); and a surface positioned forward of a halfway point in the front-rear direction between the forwardmost surface and a rearmost surface of the housing 31 (the rear surface 41A).

The rear surface 41A of the rear wall 41 is a surface of the housing 31 that the user can see when the ink cartridge 30 in its upright posture is viewed from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31 (front surface 40A).

The top surface 39A of the top wall 39 is a surface of the housing 31 that the user can see when the ink cartridge 30 in its upright posture is viewed from above. The concept of the top surface in the present disclosure includes: a topmost surface of the housing 31 (the top surface 39A); and a surface above a vertical halfway point between this topmost surface and a bottommost surface of the housing 31 (the bottom surface 42A).

The bottom surface 42A of the bottom wall 42 is a surface of the housing 31 that the user can see when the ink cartridge 30 in its upright posture is viewed from below. The concept of the bottom surface in the present disclosure includes: the bottommost surface of the housing 31 (the bottom surface 42A); and a surface below the vertical halfway point between this bottommost surface and the topmost surface of the housing 31 (the top surface 39A).

The right surface 37A of the side wall 37 is a surface of the housing 31 that the user can see when the ink cartridge 30 in its upright posture is viewed from the right side.

The left surface 38A of the side wall 38 is a surface of the housing 31 that the user can see when the ink cartridge 30 in its upright posture is viewed from the left side.

<Sealing Member 76>

As illustrated in FIG. 5, the sealing member 76 is disposed in the passage 75A. The sealing member 76 is configured of an elastic member formed of rubber or the like. The sealing member 76 is a ring-shaped member with a through-hole 76A formed in a center thereof. The through-hole 76A has a circular shape in cross-section. The through-hole 76A has a diameter smaller than an outer diameter of the corresponding tube 102 in the cartridge-attachment portion 110 (see FIG. 2). As shown in FIG. 5, the sealing member 76 is disposed near the opening 75B of the cylinder 75 so that the through-hole 76A is at the same position as the opening 75B in the front-rear direction. The sealing member 76 has an outer diameter larger than a diameter of the opening 75B. Accordingly, when the sealing member 76 is fitted in the opening 75B, a hermetic seal is formed between the sealing member 76 and the cylinder 75 to provide a light-tight seal therebetween.

The sealing member 76 is prevented from coming off the cylinder 75 by well-known means. For example, the sealing member 76 may be fixed in the cylinder 75 by nipping the sealing member 76 between the cylinder 75 and a cap (not shown) placed over the cylinder 75, or may be fixed in the cylinder 75 by adhesive.

<Protruding Part 43>

As illustrated in FIGS. 4 and 5, the protruding part 43 is provided on a rear portion of the top surface 39A of the top wall 39.

<Projection 67>

As illustrated in FIGS. 4 and 5, the projection 67 is provided on the top surface 39A of the top wall 39. The projection 67 protrudes upward from the top surface 39A and is elongated in the front-rear direction. The projection 67 is positioned forward of the protruding part 43.

Light emitted by the optical sensor 113 of the cartridge-attachment portion 110 (see FIG. 2) is configured to be incident on either a right surface or a left surface of the projection 67. Hence, the surface of the projection 67 on which light is incident will be called a "light-blocking surface". In the present embodiment, the projection 67 is a plate formed of a resin material that contains a color material (black pigment) capable of blocking or attenuating light, for example. As a variation, a material that prevents passage of light such as aluminum foil may be affixed to at least the light-blocking surface of the projection 67.

<Circuit Board 64 and Raised Portion 70>

As illustrated in FIGS. 4 and 5, the circuit board 64 is supported on the top surface 39A of the top wall 39. The circuit board 64 is positioned rearward of the projection 67 and frontward of the protruding part 43.

The circuit board 64 includes a substrate 63, a memory 66, a battery 68, and four electrodes 65. The battery 68 is a button-shaped battery (button cell), for example.

The substrate 63 is a rigid substrate formed of glass epoxy or the like. The memory 66 and battery 68 are mounted on the substrate 63, and the electrodes 65 are formed on the substrate 63 (see FIGS. 4 and 6B).

Note that the number of electrodes 65 is determined based on the number of the contacts 132 in the cartridge-attachment portion 110 (see FIG. 2) and is not limited to four. Alternatively, the memory 66 and battery 68 may not be mounted on the substrate 63.

The substrate 63 includes a first surface 61 (upper surface), a second surface 62 (lower surface), and a side surface 69. The first surface 61 and second surface 62 are both surfaces extending in the front-rear direction and left-right direction. The first surface 61 and second surface 62 have the same shape as each other and are spaced away from each other in the vertical direction. The side surface 69 connects the first surface 61 to the second surface 62. The side surface 69 has a vertical length (i.e., a vertical distance between the first surface 61 and second surface 62) that is smaller than a length of an outer periphery of the first surface 61 (i.e., a sum of a length of each of two sides extending in the front-rear direction and a length of each of two sides extending in the left-right direction of the first surface 61). In other words, dimensions of the substrate 63 in the front-rear direction and in the left-right direction are each greater than a dimension of the substrate 63 in the vertical direction.

The first surface 61 of the substrate 63 is exposed to the outside of the ink cartridge 30. That is, the substrate 63 is arranged such that the first surface 61 faces upward in the upright posture. The second surface 62 is opposite the first surface 61. That is, in the present embodiment, the first surface 61 constitutes a top surface of the substrate 63, and the second surface 62 constitutes a bottom surface of the substrate 63.

The substrate 63 is bonded to the top surface 39A of the top wall 39 with a photopolymer. Here, the circuit board 64 (substrate 63) may be bonded to the top surface 39A with an adhesive other than a photopolymer, or may be fixed to the top surface 39A by means other than adhesives, such as thermal caulking. Still alternatively, the substrate 63 may not be directly attached to the top surface 39A. For example, the substrate 63 may be attached to a top surface of a protrusion that protrudes further upward than the top surface 39A.

The memory 66 and battery 68 are mounted on the second surface 62 of the substrate 63. Here, in the present embodiment, a recess (not shown) is formed in the top wall 39 (on the top surface 39A) at a position corresponding to the memory 66 and battery 68, so that the memory 66 and battery 68 are accommodated in the recess. Incidentally, the memory 66 and battery 68 may be mounted on the first surface 61, rather than on the second surface 62. In this case, the recess for accommodating the memory 66 an battery 68 is not necessary to be formed.

The memory 66 stores information related to the ink cartridge 30 that can be read by the controller 1 of the printer 10. The information relating to the ink cartridge 30 may be data specifying a lot number, a manufactured date, an ink color, and the like. Incidentally, the memory 66 may also store information relating to data indicative of an amount of ink stored in the ink cartridge 30, such as an amount of consumed ink. The memory 66 may be a semiconductor memory, such as a non-volatile memory (FRAM®, for example), or a volatile memory (SRAM, for example).

The battery 68 is electrically connected to the memory 66 via wires (not shown), for example. With this structure, the battery 68 can supply power to the memory 66. In a case where the memory 66 includes SRAM, the information can be retained in the memory 66 by the power supplied from the battery 68, without power supply from a main body of the printer 10.

Alternatively, in place of the battery 68 of the embodiment, an electronic component other than the battery may be mounted on the substrate 63 for supplying power to the memory. For example, a capacitor in a charged state can be employed as the electronic component. The capacitor may be charged by being inserted in the main body of the printer 10, or by receiving power from an external power source.

As illustrated in FIG. 3B, each of the four electrodes 65 formed on the substrate 63 corresponds to one of the four contacts 132 in the cartridge-attachment portion 110. As shown in FIG. 6B, the four electrodes 65 are exposed on the first surface 61 to allow electrical connection to the electrodes 65. Each electrode 65 extends in the front-rear direction. The electrodes 65 are arranged parallel to one another and are spaced apart from one another in the left-right direction on the first surface 61 of the substrate 63. Each electrode 65 is electrically connected to the memory 66.

As illustrated in FIGS. 4 and 6B, the raised portion 70 is provided on the top wall 39 at a position frontward of the circuit board 64 and rearward of the projection 67. The raised portion 70 protrudes upward from the top surface 39A of the top wall 39. The raised portion 70 has a rear surface in contact with a front surface 69B of the side surface 69 of the substrate 63 of the circuit board 64. The raised portion 70 has a top surface positioned lower than the first surface 61 of the substrate 63. Incidentally, the top surface of the raised portion 70 may be positioned at the same level as the first surface 61 in the vertical direction, or may be higher than the first surface 61. Alternatively, the ink cartridge 30 may not include the raised portion 70.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIGS. 4 and 5 show the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, thereby opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110 as shown in FIG. 2, nothing is positioned between the light-emitting part and light-receiving part of the optical sensor 113. Hence, light is allowed to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

Figure 7:
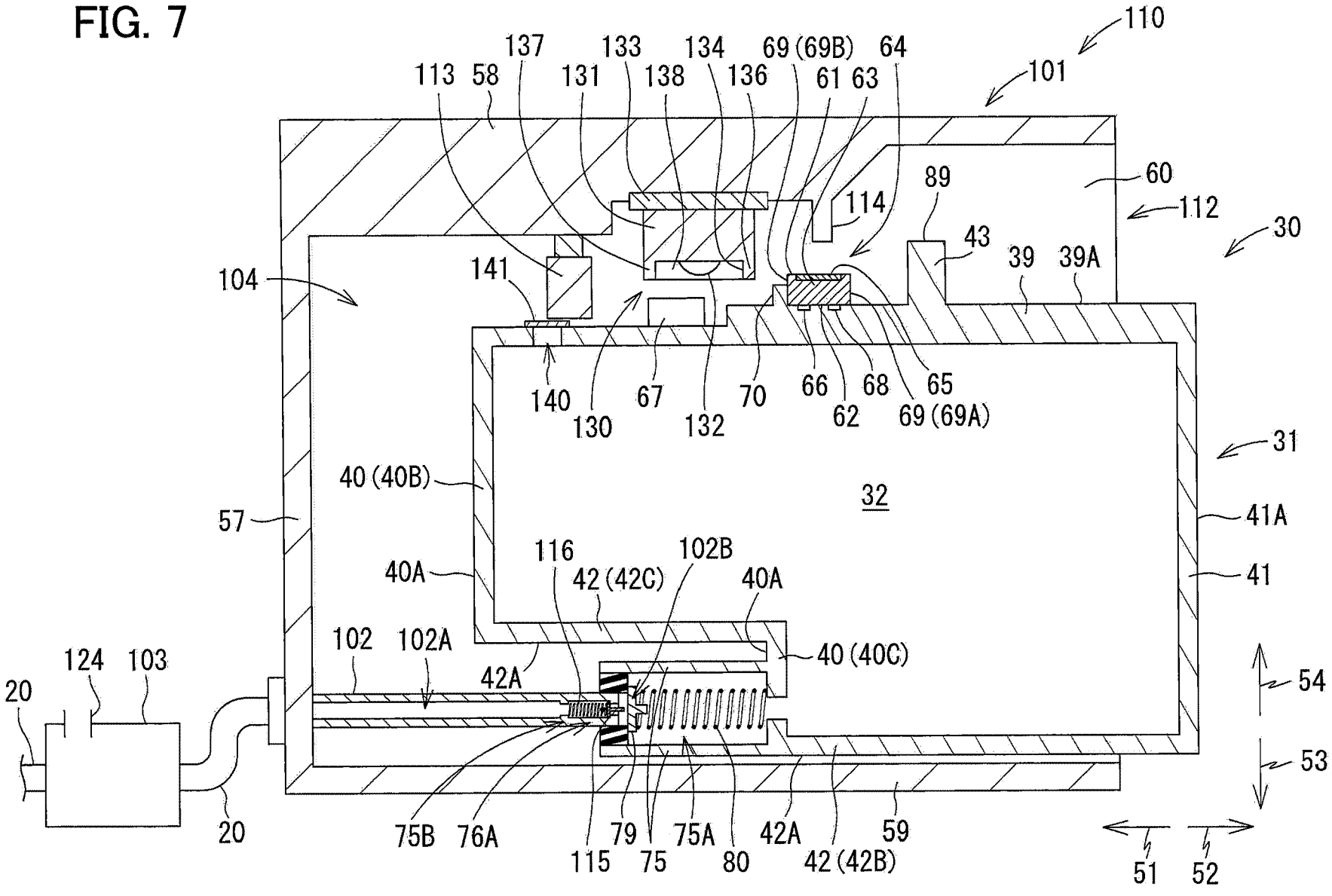
FIG. 7 is a vertical cross-sectional view illustrating a state where the ink cartridge according to the embodiment is inserted into the cartridge-attachment section.

In order to attach the ink cartridge 30 to the cartridge-attachment portion 110, the user inserts the ink cartridge 30 forward into the cartridge holder 101 through the opening 112 of the cartridge-attachment portion 110 (see FIG. 7). In the present embodiment, the ink cartridge 30 is inserted into the cartridge holder 101 in the upright posture. However, the ink cartridge 30 may instead be inserted into the cartridge holder 101 in an inclined posture inclined relative to the horizontal direction.

As the ink cartridge 30 is inserted forward into the cartridge holder 101 as shown in FIG. 7, the tube 102 of the cartridge-attachment portion 110 penetrates through the through-hole 76A of the sealing member 76 (opening 75B) to be inserted into the passage 75A of the cylinder 75. At this time, the outer circumferential surface of the tube 102 closely contacts an inner circumferential surface of the sealing member 76 (the surface defining the through-hole 76A). This configuration not only forms a liquid-tight seal between the cylinder 75 and tube 102 that prevents ink from leaking into the cartridge holder 101, but also fixes the position of the cylinder 75 relative to the cartridge holder 101.

The tube 102 inserted in the passage 75A also contacts and pushes the valve 79 rearward. Through this action, the valve 79 is separated from the sealing member 76 against a forward urging force of the coil spring 80 (see FIG. 8).

Further, while the distal end of the tube 102 contacts the valve 79, the valve 79 contacts the valve 115 from a rear side thereof and pushes the valve 115 forward. Consequently, the valve 115 moves forward against the urging force of the coil spring 116. Through this action, the interior space 102A of the tube 102 is made in communication with the exterior of the tube 102 through the opening 102B.

As a result, the ink stored in the storage chamber 32 can flow into the tank 103 and recording head 21 via the interior space 102A of the tube 102. At this time (in the state shown in FIG. 8), the circuit board 64 is not yet in contact with the cartridge-attachment portion 110.

Figure 8:
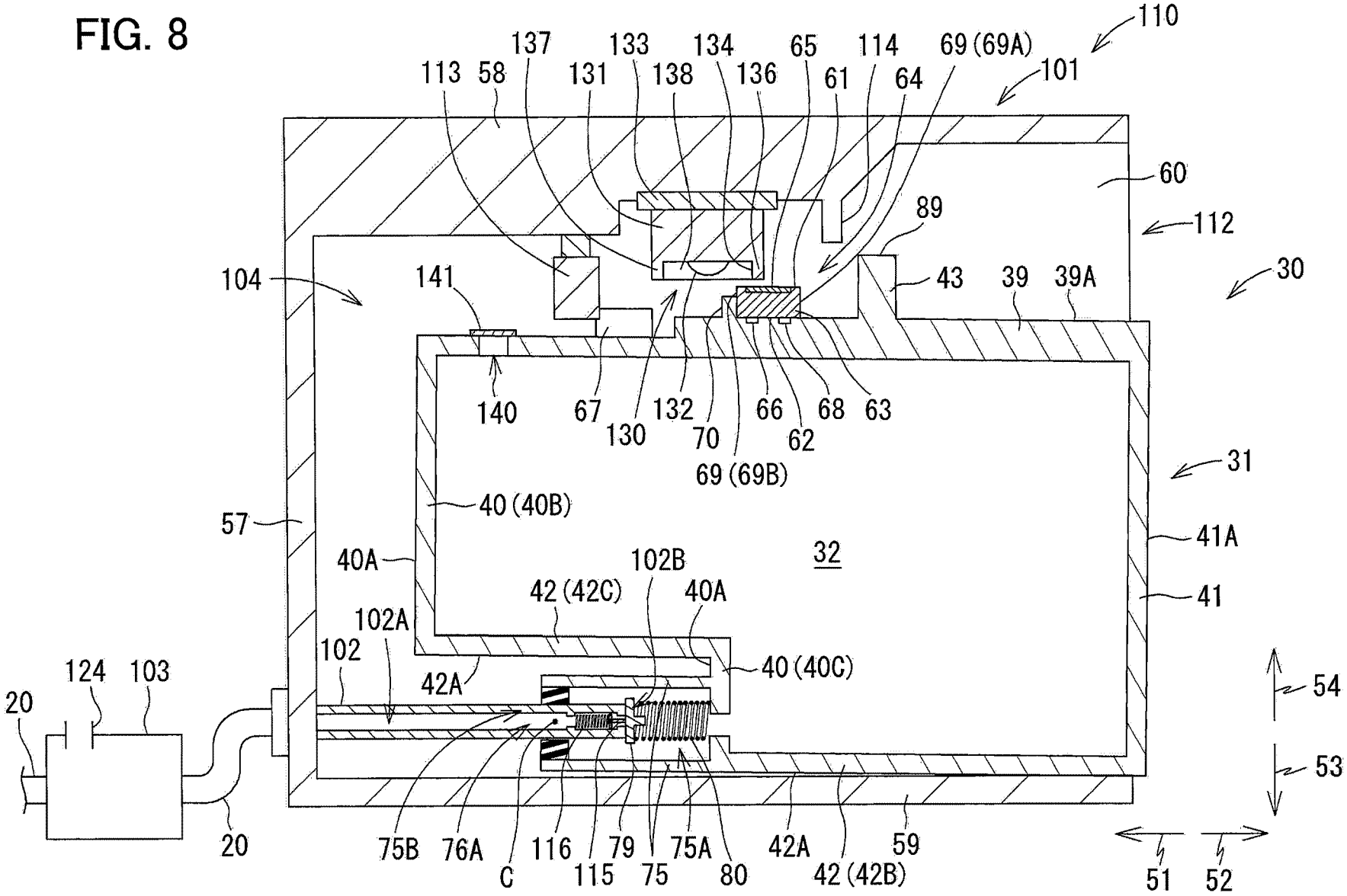
FIG. 8 is a vertical cross-sectional view illustrating a state where the ink cartridge according to the embodiment is inserted further into the cartridge-attachment section and is in a pivoted posture.

In a case where the ink cartridge 30 is inserted forward into the cartridge holder 101 from the state of FIG. 7, the circuit board 64 may abut against the rear wall 136 of the connector 130 from rearward thereof. Hence, during the forward insertion of the ink cartridge 30 into the cartridge holder 101 from the state of FIG. 7, the ink cartridge 30 is manually pivoted downward by the user such that a rear end portion of the ink cartridge 30 moves downward, as illustrated in FIG. 8. This pivotal movement of the ink cartridge 30 moves the circuit board 64 further downward of the rear wall 136, thereby preventing collision of the circuit board 64 against the rear wall 136.

The ink cartridge 30 is caused to pivot about a pivot center C that is a center (diametrical center) of the opening 75B into which the tube 102 is inserted. The position of the pivot center C may vary depending on shapes of the tube 102 and opening 75B. In the present embodiment, the pivot center C is a hypothetical center of a contact portion between an outer peripheral surface of the tube 102 and an inner surface of the sealing member 76. The posture of the ink cartridge 30 at this time (the posture shown in FIG. 8) will be referred to as "pivoted posture", hereinafter.

In the state of FIG. 8 where the ink cartridge 30 is in the pivoted posture, the sealing member 76 is elastically deformed. Accordingly, in the pivoted posture of the ink cartridge 30, elastic restoration force of the sealing member 76 is applied to the ink cartridge 30 (housing 31). The elastic restoration force of the sealing member 76 prompts the ink cartridge 30 to move back to its posture prior to the pivoting, but the ink cartridge 30 does not actually move back to its posture before pivoting because the user is holding the ink cartridge 30.

As the ink cartridge 30 is inserted further forward from the state of FIG. 8 against the rearward urging forces of the coil springs 80 and 116, the circuit board 64 arrives at a position below the contacts 132. Indeed, since the ink cartridge 30 is inclined as a result of the pivotal movement and the circuit board 64 is moved beneath the rear wall 136, the circuit board 64 can move forward past the rear wall 136 while passing below the rear wall 136, and therefore arrives at a position vertically below the contacts 132. Further, in the pivoted posture of the ink cartridge 30, a space is provided between the contacts 132 and the electrodes 65 of the circuit board 64, i.e., the electrodes 65 are separated from the contacts 132. Further, while a top surface 89 of the protruding part 43 comes to a position below the protruding part 114 of the cartridge holder 101, a space is still available between the protruding part 114 and the protruding part 43 in the vertical direction, i.e., the protruding part 114 is separated from the protruding part 43 in the pivoted posture of the ink cartridge 30.

When the user releases his hand from the ink cartridge 30 at this time, the ink cartridge 30 is pivoted counterclockwise in FIG. 8 (upward) about the pivot center C due to the elastic restoration force of the sealing member 76. The ink cartridge 30 thus moves back to the posture prior to pivoting (see the posture illustrated in FIG. 9). In the state shown in FIG. 9, the ink cartridge 30 is in the attached state to the cartridge-attachment portion 110. In the attached state, the cartridge holder 101 holds the ink cartridge 30 in the interior space 104.

Hereinafter, the attached state of the ink cartridge 30 in the cartridge-attachment portion 110 (the ink cartridge 30 in its operational posture) will be described with reference to FIGS. 9 and 10.

In the attached state depicted in FIG. 9, the tube 102 of the cartridge-attachment portion 110 is inserted inside the passage 75A of the cylinder 75. Hence, the ink in the storage chamber 32 can flow into the interior space 102A of the tube 102.

Further, the projection 67 is positioned between the light-emitting part and light-receiving part of the optical sensor 113. Consequently, the projection 67 blocks the progression of light from the light-emitting part to the light-receiving part. That is, in the attached state of the ink cartridge 30, the projection 67 is positioned in the optical path of the light irradiated from the light-emitting part. Put different way, the optical sensor 113 is arranged such that the light-blocking surface of the projection 67 is located on the optical path of the light irradiated from the light-emitting part when the ink cartridge 30 is in the attached state. At this time, the optical sensor 113 outputs a low level detection signal to the controller 1 (see FIG. 1).

As a result of the counterclockwise pivoting of the ink cartridge 30, the electrodes 65 of the circuit board 64 come into contact with the respective contacts 132 from below, thereby resiliently deforming the contacts 132 upward (see FIGS. 9 and 10). That is, in the attached state, the electrodes 65 are electrically connected to the contacts 132 while resiliently deforming the contacts 132 upward. With the four electrodes 65 contacting the corresponding contacts 132 so that electricity can be conducted therebetween, a voltage Vc is applied to the electrodes 65, the electrodes 65 are grounded, and power is supplied to the electrodes 65. Through this electrical connection between the contacts 132 and electrodes 65, the memory 66 mounted on the circuit board 64 is also electrically connected to the controller 1 (see FIG. 1). Consequently, the controller 1 can access the memory 66, enabling data stored in the memory 66 to be inputted into the controller 1 (see FIG. 1).

Figure 10:
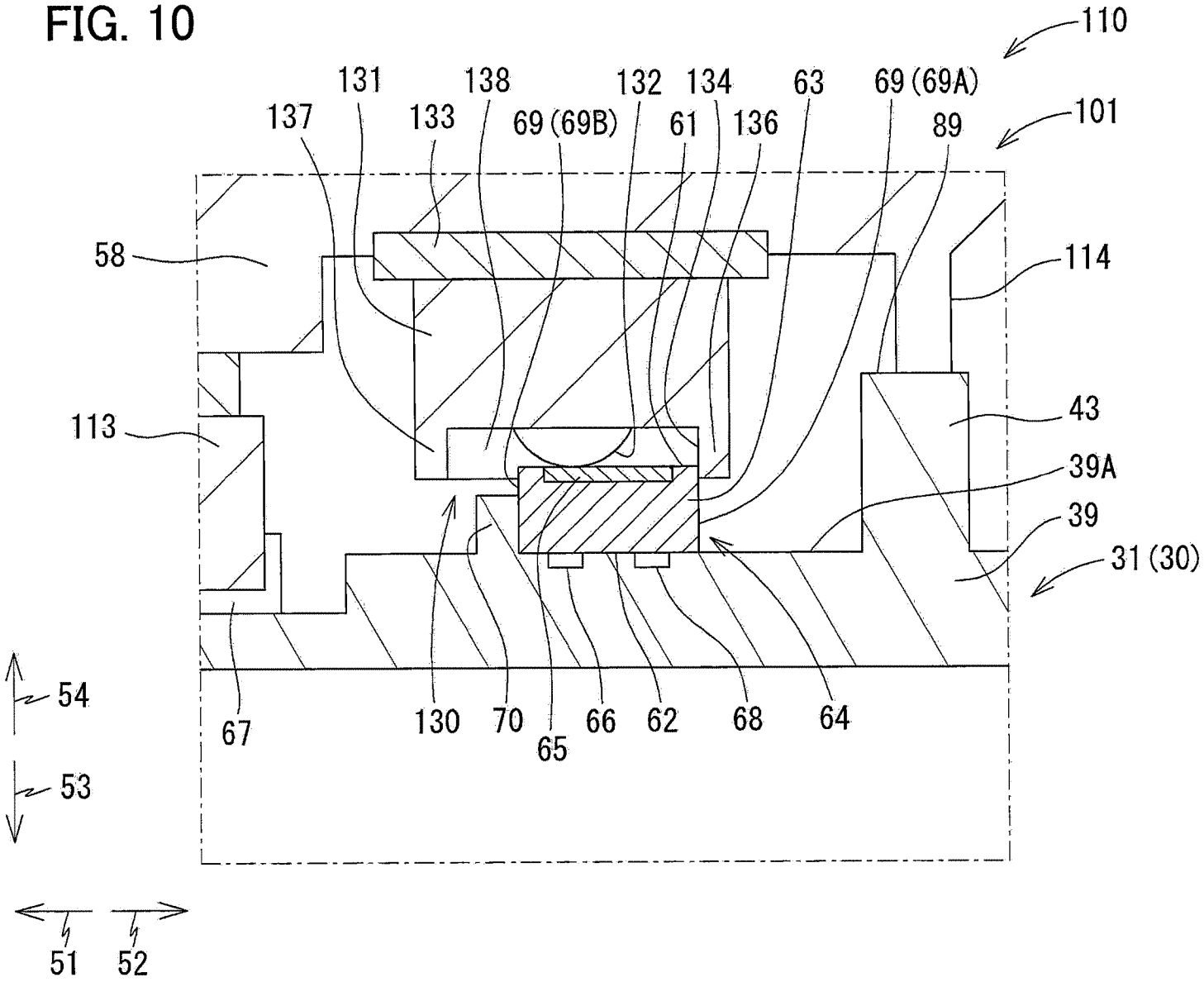
FIG. 10 is an enlarged view of an area enclosed by a chain line in FIG. 9.

Also, in the attached state shown in FIGS. 9 and 10, the front wall 137 of the connector 130 is positioned frontward of the circuit board 64, while the rear wall 136 of the connector 130 is positioned rearward of the circuit board 64. That is, the electrodes 65 are interposed between the front wall 137 and rear wall 136 in the front-rear direction when the ink cartridge 30 is in the attached state. In other words, the rear wall 136 and front wall 137 are juxtaposed in the front-rear direction with the electrodes 65 interposed therebetween.

Further, as shown in FIG. 3B, the right wall 138 of the connector 130 is positioned rightward of the circuit board 64, whereas the left wall 139 of the connector 130 is positioned leftward of the circuit board 64 in the attached state of the ink cartridge 30. Further, bottom edges of the right wall 138 and left wall 139 are positioned lower than the electrodes 65. With this configuration, the right wall 138 and left wall 139 interpose the electrodes 65 therebetween in the left-right direction when the ink cartridge 30 is in the attached state. That is, the right wall 138 and left wall 139 are juxtaposed in the left-right direction with the electrodes 65 interposed therebetween.

In the state where the electrodes 65 are in contact with the contacts 132 from below after the pivoting of the ink cartridge 30, an upper edge of the circuit board 64 is positioned higher than a bottom edge of the rear wall 136 (see FIG. 10). That is, in the attached state of the ink cartridge 30, a portion of the side surface 69 of the substrate 63 (more specifically, a rear surface 69A facing rearward) faces and contacts a front surface 134 of the rear wall 136 (i.e., one of side surfaces facing frontward) from frontward thereof. Although the ink cartridge 30 is applied with the rearward urging forces of the coil springs 80 and 116, the ink cartridge 30 in the attached state is prevented from being moved further rearward due to the contact of the rear surface 69A of the substrate 63 of the circuit board 64 against the front surface 134 of the rear wall 136. The ink cartridge 30 is thus fixed in position within the cartridge holder 101 in the front-rear direction.

Further, as a result of the pivoting of the ink cartridge 30, the top surface 89 of the protruding part 43 are made in contact with the protruding part 114 from below. This contact of the protruding part 43 against the protruding part 114 can prevent the ink cartridge 30 from moving further upward, i.e., from pivoting further counterclockwise about the pivot center C. The ink cartridge 30 is thus fixed in position within the cartridge holder 101 in the vertical direction.

To extract the ink cartridge 30 from the cartridge holder 101 of the cartridge-attachment portion 110, the user holds the ink cartridge 30 to pivot the ink cartridge 30 such that the rear end portion of the ink cartridge 30 moves downward. rearward. Through this operation, the protruding part 43 is separated from the protruding part 114 and the upper edge of the circuit board 64 is moved downward below the lower end of the rear wall 136. The ink cartridge 30 is thus moved into the pivoted posture. In the pivoted posture, the ink cartridge 30 is moved rearward due to the rearward urging forces of the coil springs 80 and 116. The ink cartridge 30 can be thus removed from the cartridge-attachment portion 110.

<Detecting Attachment of the Ink Cartridge 30 to the Cartridge-Attachment Portion 110>

Next, operations for detecting attachment of an ink cartridge 30 to the cartridge-attachment portion 110 will be described with reference to flowcharts shown in FIGS. 11 and 12.

Figure 11:
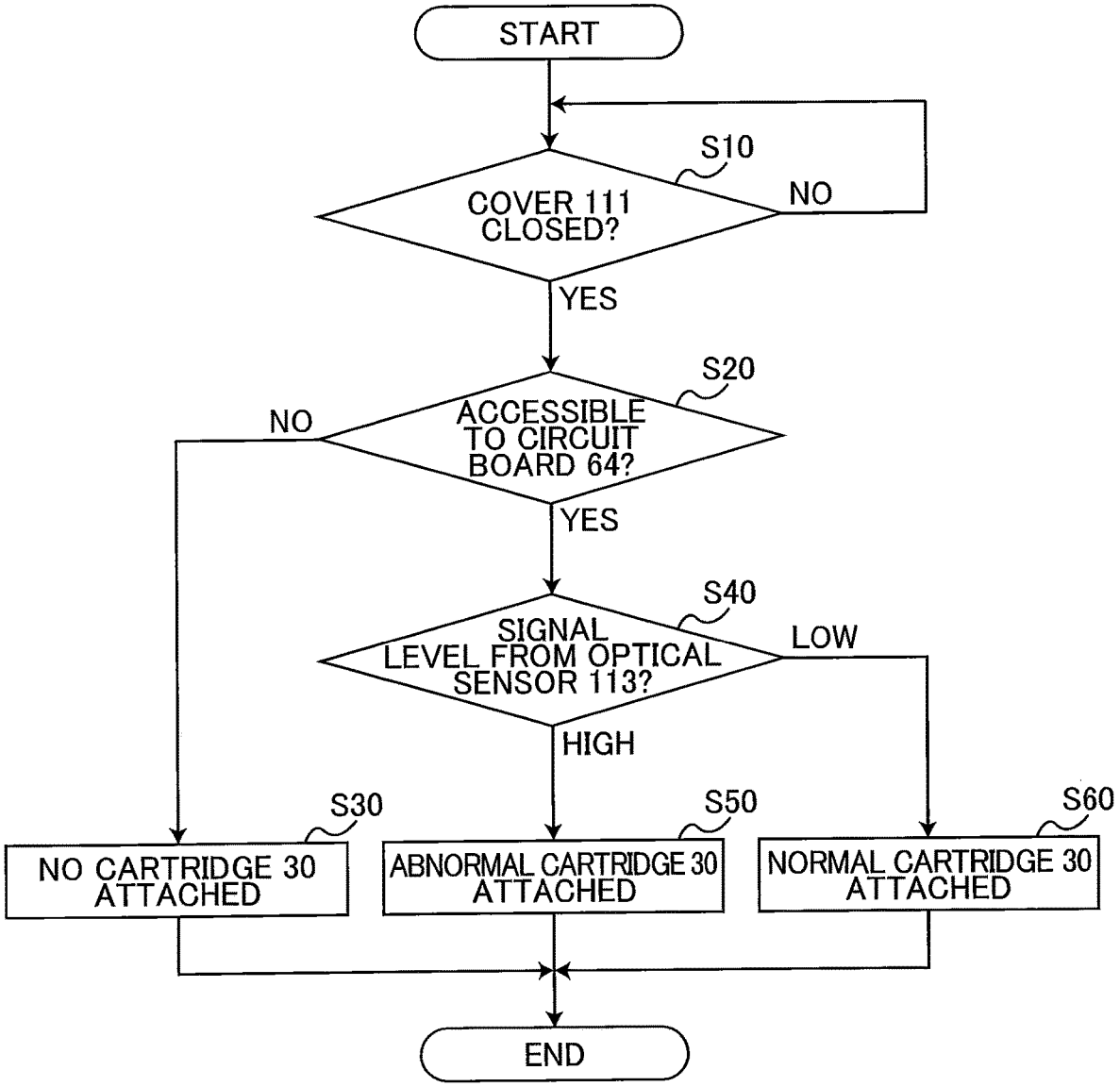
FIG. 11 is a flowchart illustrating steps to determine whether the ink cartridge according to the embodiment is attached to the cartridge-attachment section.
Figure 12:
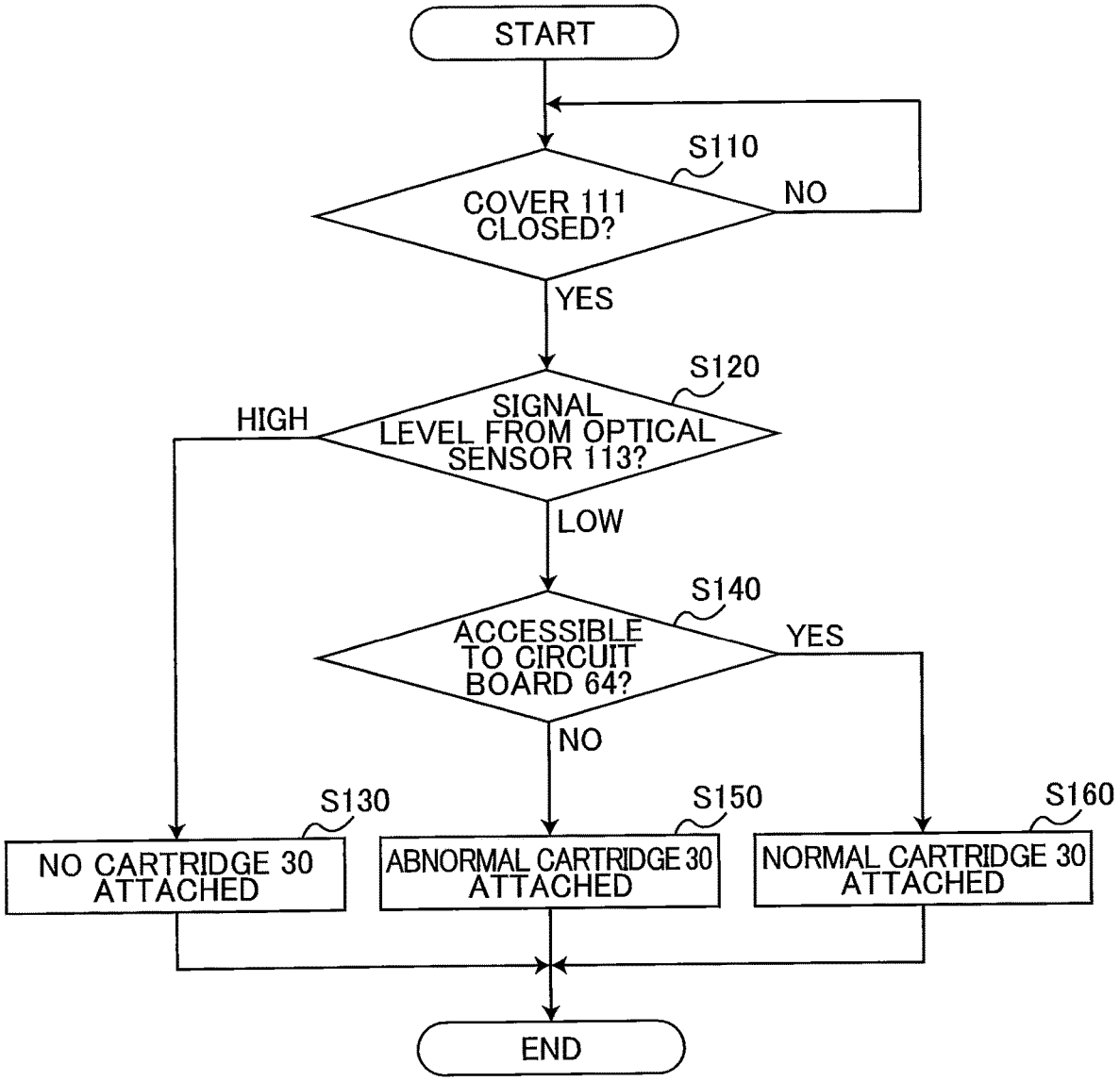
FIG. 12 is a flowchart illustrating another way of determining whether the ink cartridge according to the embodiment is attached to the cartridge-attachment section.

The flowcharts of FIGS. 11 and 12 are configured to be initiated when the cover 111 is opened by the user. That is, the controller 1 is configured to launch the flowchart of FIG. 11 or the flowchart of FIG. 12 in response to receiving a high level signal outputted from the cover sensor 118.

As shown in FIG. 11, in S10 the controller 1 (see FIG. 1) determines whether the cover 111 is in the closed position. Specifically, the controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory 66 on the circuit board 64 of the ink cartridge 30 is accessible, i.e., whether the controller 1 can read from or write to the memory 66. The controller 1 is able to access the memory 66 on the circuit board 64 when the contacts 132 are in contact with and electrically connected to the electrodes 65 on the circuit board 64. When the contacts 132 are not in contact with the electrodes 65 on the circuit board 64, the controller 1 cannot access the memory 66.

If the controller 1 cannot access the memory 66 of the circuit board 64 (S20: NO), in S30 the controller 1 determines that no ink cartridge 30 is mounted in the cartridge-attachment portion 110. In this case, the controller 1 notifies the user that no ink cartridge 30 is mounted by displaying a message on a display panel (not shown) provided on a housing of the printer 10 and/or emitting a beep or other sound from a speaker (not shown).

When the controller 1 can access the circuit board 64 (S20: YES), in S40 the controller 1 determines whether the signal outputted from the optical sensor 113 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), the controller 1 determines in S50 that an abnormal ink cartridge 30 is attached to the cartridge-attachment portion 110. In this case, the controller 1 notifies the user that an abnormal ink cartridge 30 is mounted by displaying a message on the display panel (not shown) provided on the housing of the printer 10 and/or playing a beep or other sound from the speaker (not shown).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 11, the controller 1 determines whether an ink cartridge 30 is mounted in the cartridge-attachment portion 110 based on whether the circuit board 64 is accessible, and determines whether the ink cartridge 30 mounted in the cartridge-attachment portion 110 is normal based on the level of the signal outputted from the optical sensor 113.

Alternatively, the controller 1 may be configured to determine whether an ink cartridge 30 is mounted in the cartridge-attachment portion 110 based on the level of the signal outputted from the optical sensor 113 and to determine whether the ink cartridge 30 mounted in the cartridge-attachment portion 110 is normal based on whether the circuit board 64 is accessible. Steps in this variation will be described next with reference to the flowchart in FIG. 12.

Referring to FIG. 12, the controller 1 first determines in S110 whether the cover 111 is in the closed position, as in S10 of the flowchart of FIG. 11. In a case where the 111 is determined to be in the open position (S110: NO), the controller 1 repeats the determination in S110 until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that no ink cartridge 30 is mounted in the cartridge-attachment portion 110. In this case, as in S30 of FIG. 11, the controller 1 notifies the user that no ink cartridge 30 is mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 11, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

Operational and Technical Advantages of the Embodiment

According to the described embodiment, the ink cartridge 30 (the substrate 63) comes into contact with the front surface 134 of the rear wall 136 from frontward thereof to provide positioning of the ink cartridge 30 in the front-rear direction. Here, the rear wall 136 and the contacts 132 are both provided in the connector 130. That is, the circuit board 64 configured to contact the contacts 132 is positioned close to the rear wall 136 that serves as a base in positioning of the ink cartridge 30. With this structure, the circuit board 64 is less likely to suffer from positional deviation relative to the contacts 132 that may occur due to tolerance in parts constituting the connector 130, or positional deviation of the ink cartridge 30 relative to the rear wall 136.

Further, the position of the circuit board 64 is fixed by the connector 130 (more specifically, by the contact against the contacts 132 provided at the connector 130). The contacts 132 are provided at the connector 130. In other words, the connector 130 provides positioning of the circuit board 64 and the contacts 132. The position of the circuit board 64 relative to the contacts 132 is therefore less likely to deviate.

Further, in the structure of the depicted embodiment, the raised portion 70 of the ink cartridge 30 can prevent the circuit board 64 from moving forward due to a rearward reaction force applied from the rear wall 136.

Various modifications are conceivable.

Hereinafter, various modifications to the embodiment will be described while referring to accompanying drawings. In the following description, structures different from those of the embodiment will be described, while like parts and components will be designated with the same reference numerals as those of the embodiment in order to avoid duplicating explanation.

First Modification

In the depicted embodiment, the circuit board 64 makes contact with the rear wall 136 from frontward thereof. However, a portion of the ink cartridge 30 different from the circuit board 64 may contact the rear wall 136 from frontward thereof.

Figure 13:
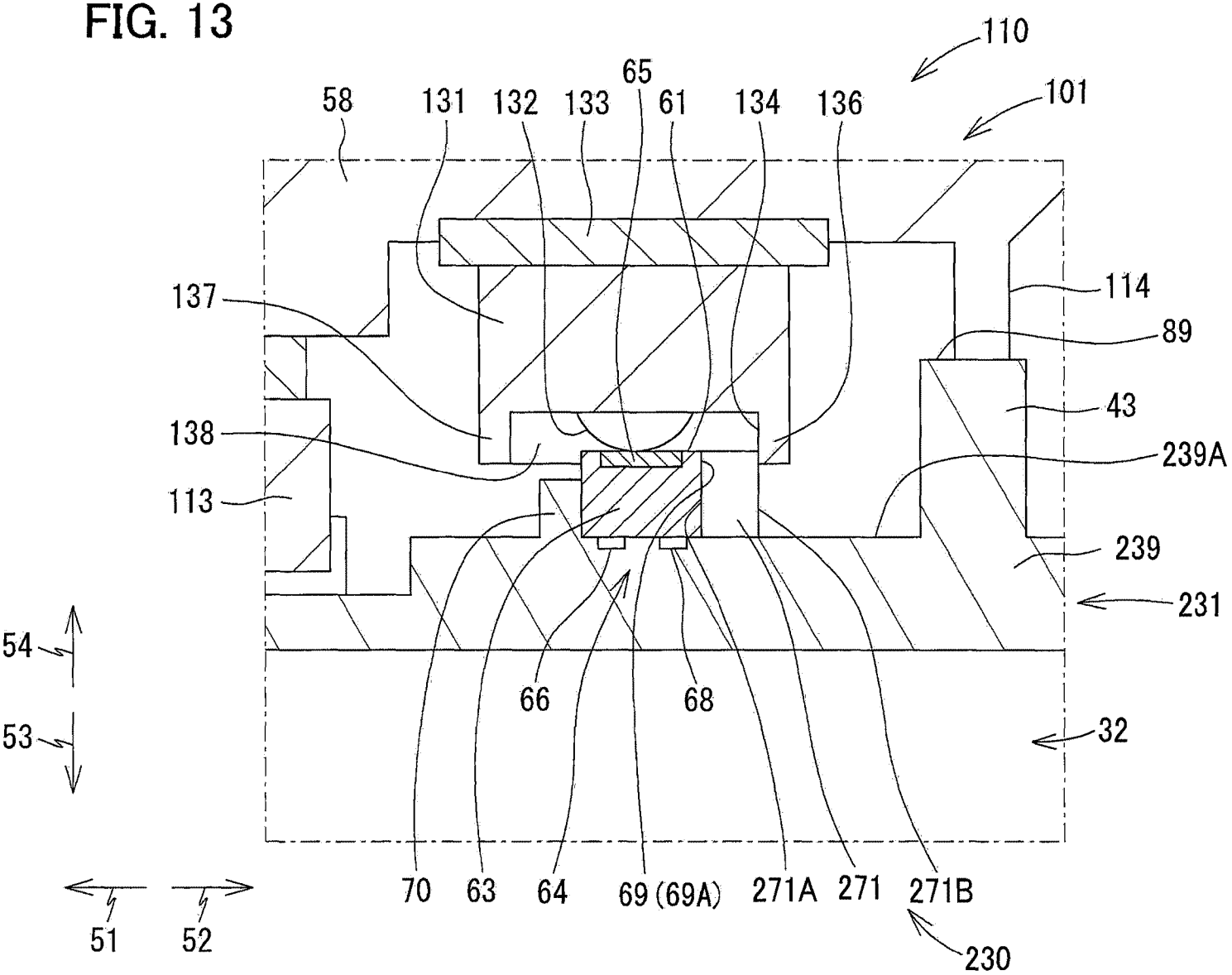
FIG. 13 is an enlarged view of an area corresponding to the area of FIG. 10 in an ink cartridge according to a first modification to the embodiment.

As an example, FIG. 13 illustrates an ink cartridge 230 according to a first modification to the embodiment. The ink cartridge 230 has substantially the same structure as the ink cartridge 30 of the embodiment, except that the ink cartridge 230 further includes a protrusion 271.

Specifically, the ink cartridge 230 includes a housing 231. The protrusion 271 is integrally formed with the housing 231. The protrusion 271 is provided on a top wall 239 of the housing 231 to protrude upward from a top surface 239A of the top wall 239. The protrusion 271 is positioned rearward of the circuit board 64 and frontward of the protruding part 43. The protrusion 271 has a front surface 271A in contact with the rear surface 69A of the substrate 63 of the circuit board 64. Further, in the present modification, an upper edge of the protrusion 271 is positioned vertically at the same level as the upper edge (first surface 61) of the circuit board 64, as illustrated in FIG. 13.

Incidentally, the protrusion 271 may not be in contact with the circuit board 64. Still alternatively, the upper edge of the protrusion 271 may be higher or lower than the upper edge (first surface 61) of the circuit board 64 in the vertical direction.

In the attached state of the ink cartridge 230 where the electrodes 65 are in contact with the contacts 132 from below, the upper edge of the protrusion 271 is positioned higher than the bottom edge of the rear wall 136 in the vertical direction. In other words, in the attached state of the ink cartridge 230, a rear surface 271B of the protrusion 271 faces the front surface 134 of the rear wall 136 in the front-rear direction. At this time, the ink cartridge 230 is urged rearward by the rearward urging forces of the coil springs 80 and 116, and, hence, the rear surface 271B is in contact with the front surface 134 from frontward thereof. That is, in the attached state of the ink cartridge 230, the protrusion 271 is in contact with the rear wall 136 from frontward thereof. This contact between the protrusion 271 and rear wall 136 restricts the ink cartridge 230 from moving further rearward from the position depicted in FIG. 13, thereby serving to fix the position of the ink cartridge 230 in the front-rear direction within the cartridge holder 101.

With this structure of the first modification, the protrusion 271, which is a separate component from the circuit board 64, is configured to make contact with the rear wall 136 of the connector 130. Accordingly, the circuit board 64 (substrate 63) is prevented from suffering from deformation, distortion or damages due to the reaction force from the rear wall 136. Further, deviation in the position of the circuit board 64 relative to the contacts 132 is less likely to occur.

Further, since the circuit board 64 is in contact with the protrusion 271 from frontward thereof, the protrusion 271 can also function to fix the position of the circuit board 64 in the front-rear direction.

Second Modification

In the first modification, the protrusion 271 (the portion adapted to abut against the front surface 134 of the rear wall 136) is integral with the housing 231. However, such a portion may be provided separately from the housing as an independent member.

Figure 14:
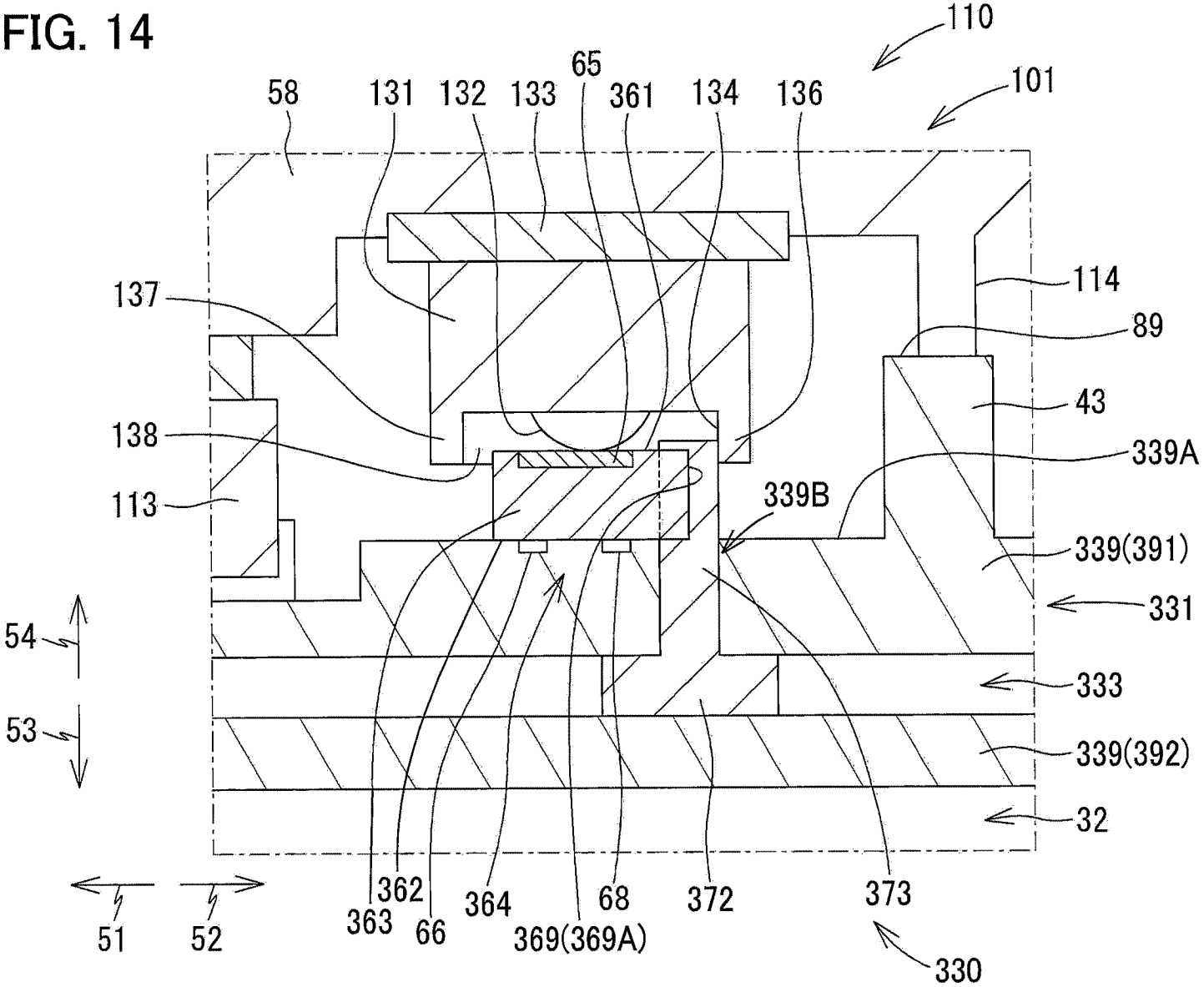
FIG. 14 is an enlarged view of an area corresponding to the area of FIG. 10 in an ink cartridge according to a second modification to the embodiment.
Figure 15:
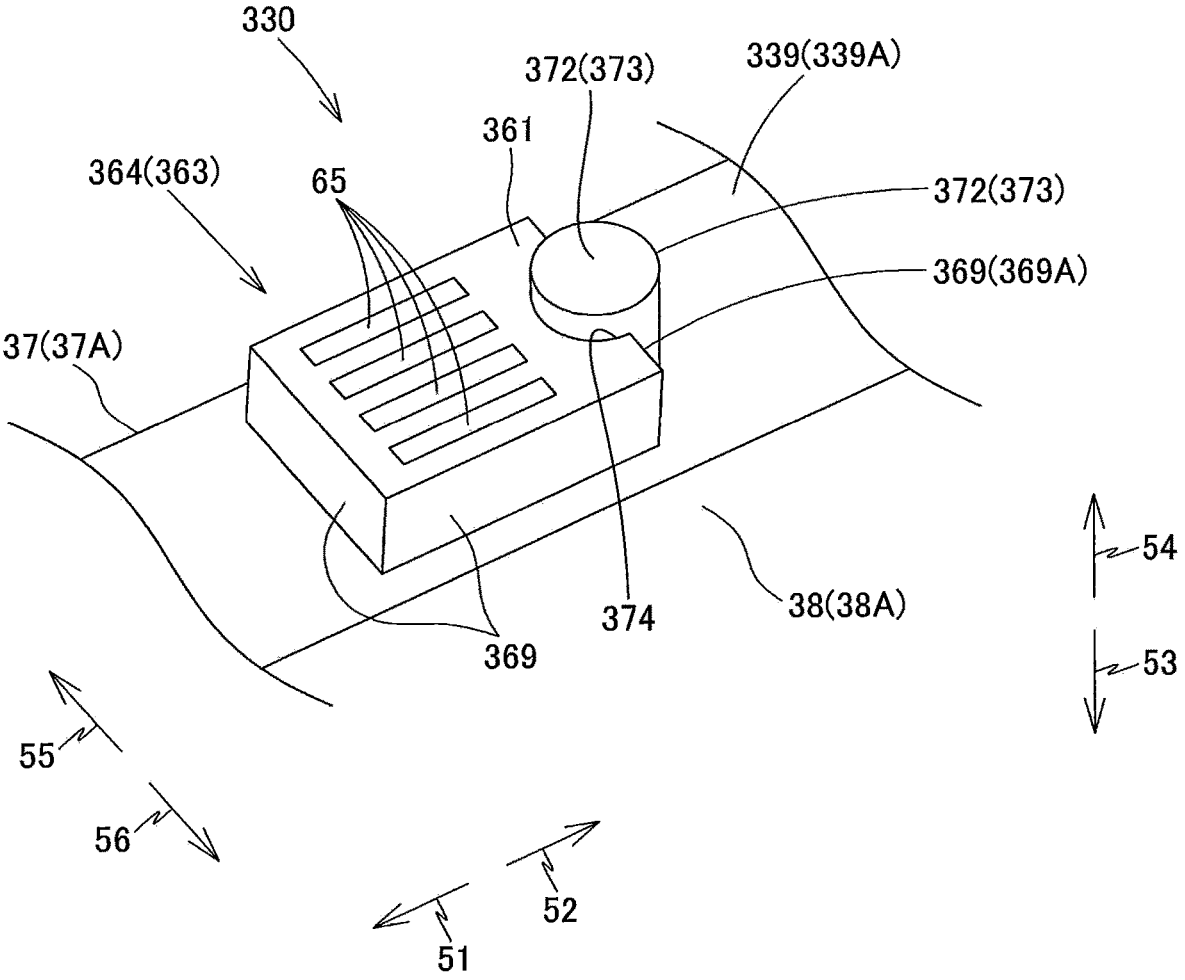
FIG. 15 is a perspective view illustrating a structure in the vicinity of a circuit board of the ink cartridge according to the second modification.
Figure 16:
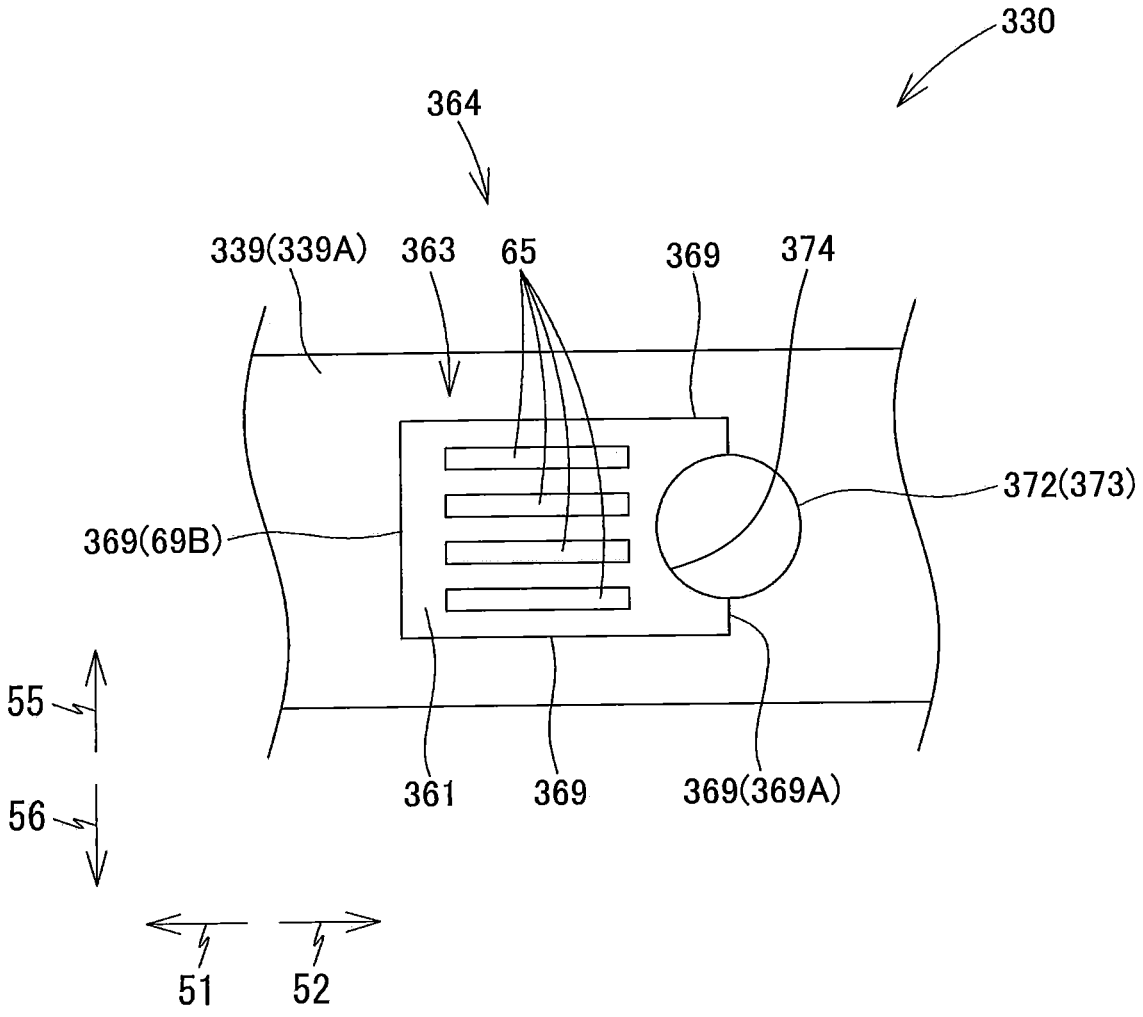
FIG. 16 is a plan view illustrating the structure in the vicinity of the circuit board of the ink cartridge according to the second embodiment.

As an example, FIGS. 14 to 16 depict an ink cartridge 330 according to a second modification to the embodiment.

The ink cartridge 330 includes a housing 331, a circuit board 364, and a contact member 372 fixed to the housing 331. More specifically, the housing 331 includes a top wall 339 configured of a first top wall 391 and a second top wall 392 arranged to be spaced apart from each other in the vertical direction. The first top wall 391 is exposed to the outside of the housing 331 and supports the circuit board 364. The second top wall 392 is disposed below the first top wall 391. A lower surface of the second top wall 392 defines an upper edge of the storage chamber 32. An upper surface of the second top wall 392 (the surface facing a lower surface of the first top wall 391) supports the contact member 372 thereon. That is, a space below the second top wall 392 serves as the storage chamber 32 of the housing 331, and the contact member 372 is disposed in a space 333 above the second top wall 392 (i.e., the space defined between the second top wall 392 and the first top wall 391).

The contact member 372 is bonded to the upper surface of the second top wall 392, and extends upward through a through-hole 339B formed in the first top wall 391. That is, the contact member 372 extends vertically into the space 333 from a position above the first top wall 391, while penetrating through the first top wall 391 through the through-hole 339B. Incidentally, the contact member 372 may be fixed to the housing 331 by means other than bonding, for example, by press fitting to the housing 331.

The contact member 372 is made of a material having a hardness higher than a hardness of the housing 331. In the present modification, the contact member 372 is made of a metal, whereas the housing 331 is made of a resin.

The contact member 372 has an upper portion 373 having a solid circular columnar shape. The upper portion 373 penetrates the first top wall 391 through the through-hole 339B to protrude farther upward relative to a top surface 339A of the top wall 339 (the upper surface of the first top wall 391). The upper portion 373 is positioned rearward of the circuit board 64 and frontward of the protruding part 43.

Further, the circuit board 364 of the second modification includes a substrate 363 formed with a recess 374 on a rear surface 369A. Specifically, the substrate 363 has a first surface (upper surface) 361, a second surface (lower surface) 362, and a side surface 369 including the rear surface 369A. The recess 374 is recessed frontward on the rear surface 369A to have an accurate shape in a top view, as illustrated in FIG. 16. The recess 374 defines an inner diameter substantially identical to an outer diameter of the upper portion 373 of the contact member 372. The upper portion 373 is in contact with the recess 374 from frontward thereof. Accordingly, the upper portion 373 of the contact member 372 can fix the position of the circuit board 364 not only in the front-rear direction but also in the left-right direction.

Incidentally, the upper portion 373 may not necessarily be circular columnar shaped. In this case, the recess 374 may be recessed to have a shape other than the arcuate shape in conformance with the shape of the upper portion 373. Alternatively, the circuit board 364 may not be formed with the recess 374, provided that the circuit board 364 is in contact with the upper portion 373 of the contact member 372, as in the first modification of FIG. 13. Still further, the upper edge of the contact member 372 (the top surface of the upper portion 373) may be at the same level as or lower than the upper edge of the circuit board 364 (the first surface 361 of the substrate 363) in the vertical direction.

In a state where the ink cartridge 330 is pivoted to place the electrodes 65 in contact with the contacts 132 from below, the upper edge of the contact member 372 is positioned higher than the bottom edge of the rear wall 136, as shown in FIG. 14. That is, in the attached state of the ink cartridge 330, the contact member 372 faces the front surface 134 of the rear wall 136 in the front-rear direction. Due to the rearward urging forces of the coil springs 80 and 116, the ink cartridge 330 in the attached state is urged rearward to allow the contact member 372 (a rear surface of the upper portion 373) to make contact with the front surface 134 from fromward thereof (see FIG. 14). In other words, in the attached state of the ink cartridge 330, the contact member 372 abuts on the rear wall 136 from frontward thereof. With this structure, the ink cartridge 330 is restricted from moving further rearward, thereby being fixed in position within the cartridge holder 101 in the front-rear direction.

According to the structure of the second modification, the contact member 372 is less likely to be distorted or damaged by the reaction force of the rear wall 136, since the hardness of the contact member 372 is higher than the hardness of the housing 331.

Further, the contact member 372 of the second modification can provide positioning of the circuit board 364 both in the front-rear direction and in the left-right direction.

Third Modification

In the above-described embodiment and first and second modifications, the circuit board 64, 364 is supported on the top surface 39A, 239A, 339A of the top wall 39, 239 and 339. That is, an entirety of the circuit board 64, 364 is positioned outside of the housing 31, 231, 331. However, part of the circuit board 64 may be positioned inside the housing, whereas a remaining portion of the circuit board may 64 be positioned outside of the housing.

Further, in the depicted embodiment, the substrate 63 of the circuit board 64 is arranged such that the front-rear and left-right dimensions of the substrate 63 are greater than a vertical dimension thereof, i.e., in a horizontal orientation. However, the substrate 63 may be disposed such that the vertical dimension thereof is greater than front-rear and left-right dimensions thereof, i.e., in a vertical orientation.

Figure 17:
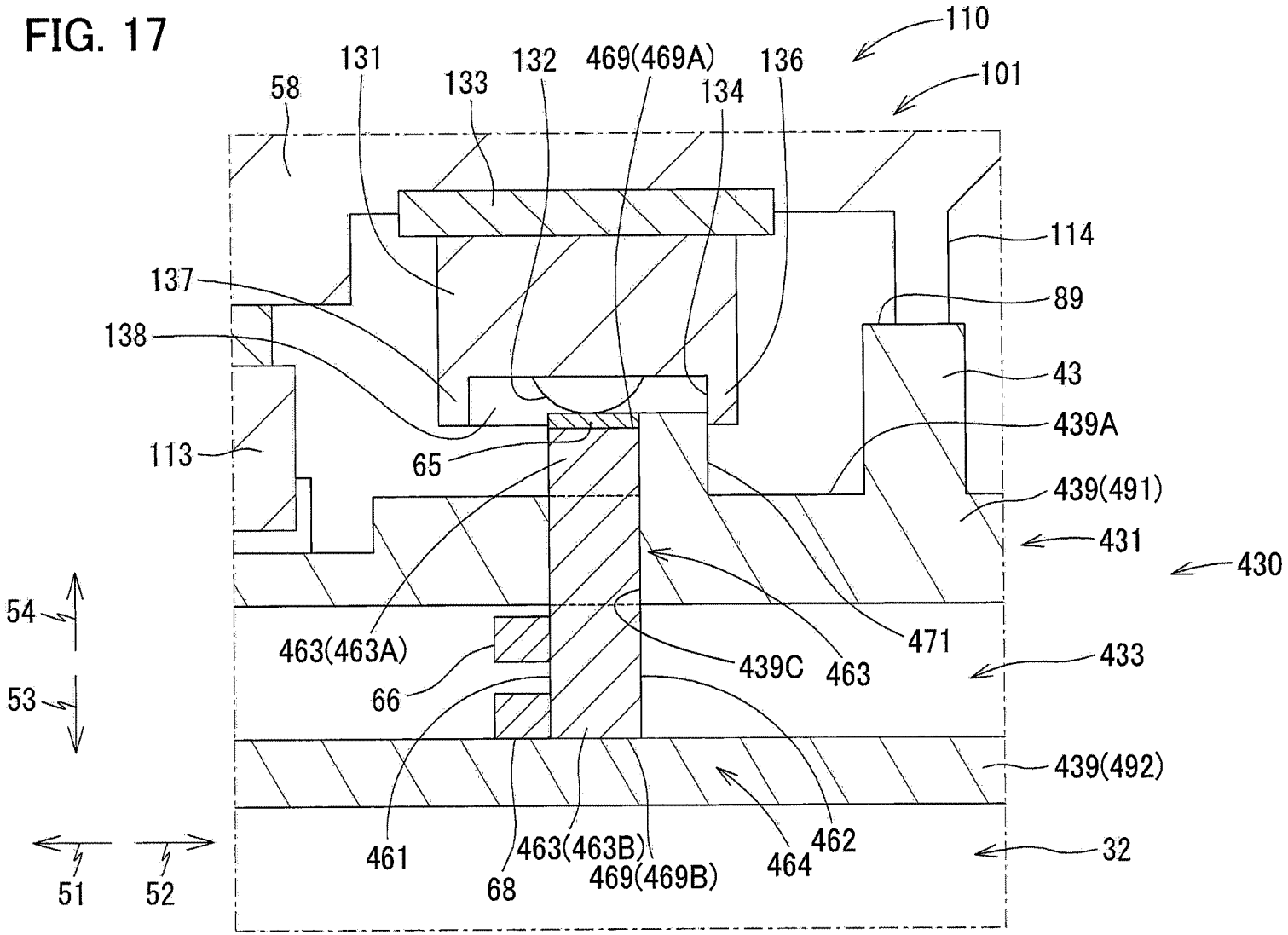
FIG. 17 is an enlarged view of an area corresponding to the area of FIG. 10 in an ink cartridge according to a third modification to the embodiment.
Figure 18:
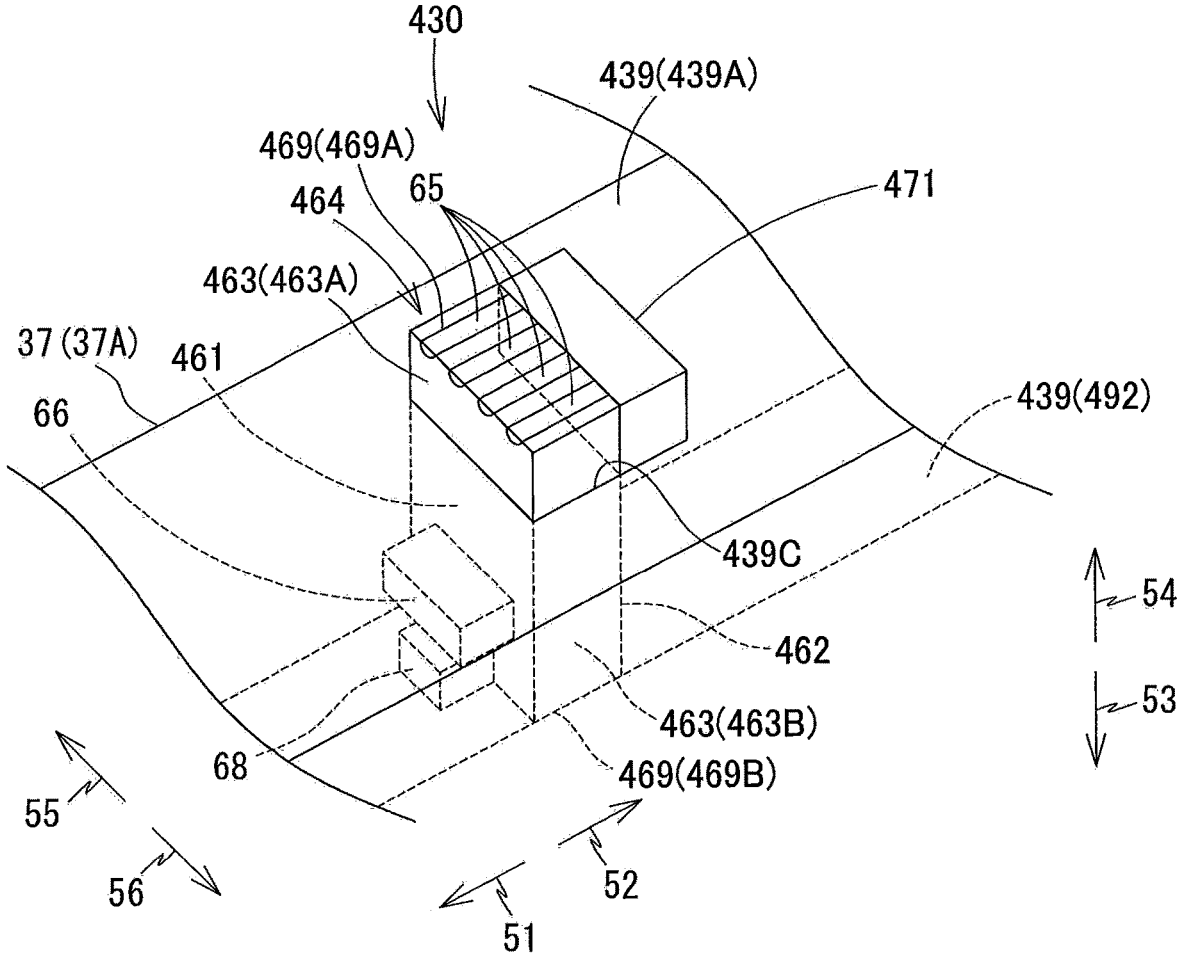
FIG. 18 is a perspective view illustrating a structure in the vicinity of a circuit board of the ink cartridge according to the third modification.

As an example, FIGS. 17 and 18 depict an ink cartridge 430 according to a third modification to the embodiment. The ink cartridge 430 includes a housing 431, and a circuit board 464. The housing 431 includes a top wall 439 formed with a through-hole 439C. The circuit board 464 is arranged to be inserted in the through-hole 439C.

Specifically, the top wall 439 is configured of a first top wall 491 and a second top wall 492 spaced apart from each other in the vertical direction, as in the second modification. The first top wall 491 is exposed to the outside of the housing 431. The second top wall 492 is disposed below the first top wall 491. The second top wall 492 has a lower surface defining the upper edge of the storage chamber 32. The second top wall 492 has an upper surface (the surface facing a lower surface of the first top wall 491) supporting the circuit board 464. That is, a space below the second top wall 492 serves as the storage chamber 32 of the housing 431, and part of the circuit board 464 (part of a substrate 463) is disposed in a space 433 above the second top wall 492 (i.e., the space defined between the second top wall 492 and the first top wall 491).

The circuit board 464 is supported on the second top wall 492 with the substrate 463 inserted in the through-hole 439C. The substrate 463 extends vertically into the space 433 from a position above the first top wall 491, while penetrating the first top wall 491 through the through-hole 439C. That is, the circuit board 464 is in the vertical orientation in the third modification. Referring to FIG. 17, the substrate 463 has an upper portion 463A positioned above the through-hole 439C (a portion above an upper broken line), and a lower portion 463B positioned below the through-hole 439C (a portion below a lower broken line).

In the vertical orientation of the circuit board 464 according to the third modification, the substrate 463 is arranged such that: the first surface 61 of the substrate 63 of the embodiment becomes a front surface 461 of the substrate 463; the second surface 62 of the substrate 63 of the embodiment becomes a rear surface 462 of the substrate 463; the rear surface 69A of the side surface 69 of the substrate 63 becomes a top surface 469A of the substrate 463; and the front surface 69B of the side surface 69 of the substrate 63 becomes a bottom surface 469B of the substrate 463. In other words, the substrate 463 is arranged such that a side surface 469 thereof (the top surface 469A) faces upward. The electrodes 65 are formed on the top surface 469A of the substrate 463 (on the side surface 469) to face upward.

The memory 66 and battery 68 are disposed at the lower portion 463B of the substrate 463 below the through-hole 439C. More specifically, the memory 66 and battery 68 are mounted on the front surface 461 of the substrate 463 to be positioned below the through-hole 439C. Incidentally, the memory 66 and battery 68 may be mounted on the substrate 463 at positions different from those of the third modification. For example, the memory 66 may be positioned on the front surface 461, while the battery 68 may be mounted on the rear surface 462. Alternatively, the memory 66 and battery 68 may be both mounted on the rear surface 462.

As illustrated in FIG. 17, a protrusion 471 is provided on the top wall 439 (first top wall 491) at a position rearward of the circuit board 464, just as the protrusion 271 of the first modification (see FIG. 13). In the attached state of the ink cartridge 430, a rear surface of the protrusion 471 is in contact with the rear wall 136 from frontward thereof. However, the protrusion 471 may be dispensed with, and the substrate 463 (more precisely, the rear surface 462 of the substrate 463) may make direct contact with the rear wall 136 from frontward thereof in the attached state of the substrate 463, as in the depicted embodiment (see FIG. 10).

According to the structure of the third modification, the circuit board 464 is arranged in the vertical orientation to extend above and below the first top wall 491 of the top wall 439. With this structure, the lower portion 463B of the substrate 463 can be protected from external impacts.

Further, the battery 68 mounted on the lower portion 463B of the substrate 463 can also be protected from external impacts.

Still further, according to the vertical orientation of the substrate 463 of the third modification, an area of the top surface 469A of the substrate 463 can be made smaller, compared to an area of the first surface 61 of the substrate 63 in the embodiment. Hence, the structure of the third modification can suppress interference between the circuit board 464 and any component(s) positioned above the circuit board 464. Further, side surfaces of the substrate 463 (surfaces facing rightward, leftward, frontward and rearward) can have a larger area, compared to the horizontal orientation of the substrate 63 in the embodiment. This structure of the third modification can enhance degree of freedom in arranging the memory 66 and battery 68 that are to be mounted on any of these larger side surfaces of the substrate 463.

Fourth Modification

In the above-described embodiment and modifications, the substrates 63, 363, 463 of the circuit boards 64, 364, 464 are rigid substrates. However, the substrate may be configured of a rigid substrate and a flexible substrate. The flexible substrate may be made of a plastic film, for example.

Figure 19:
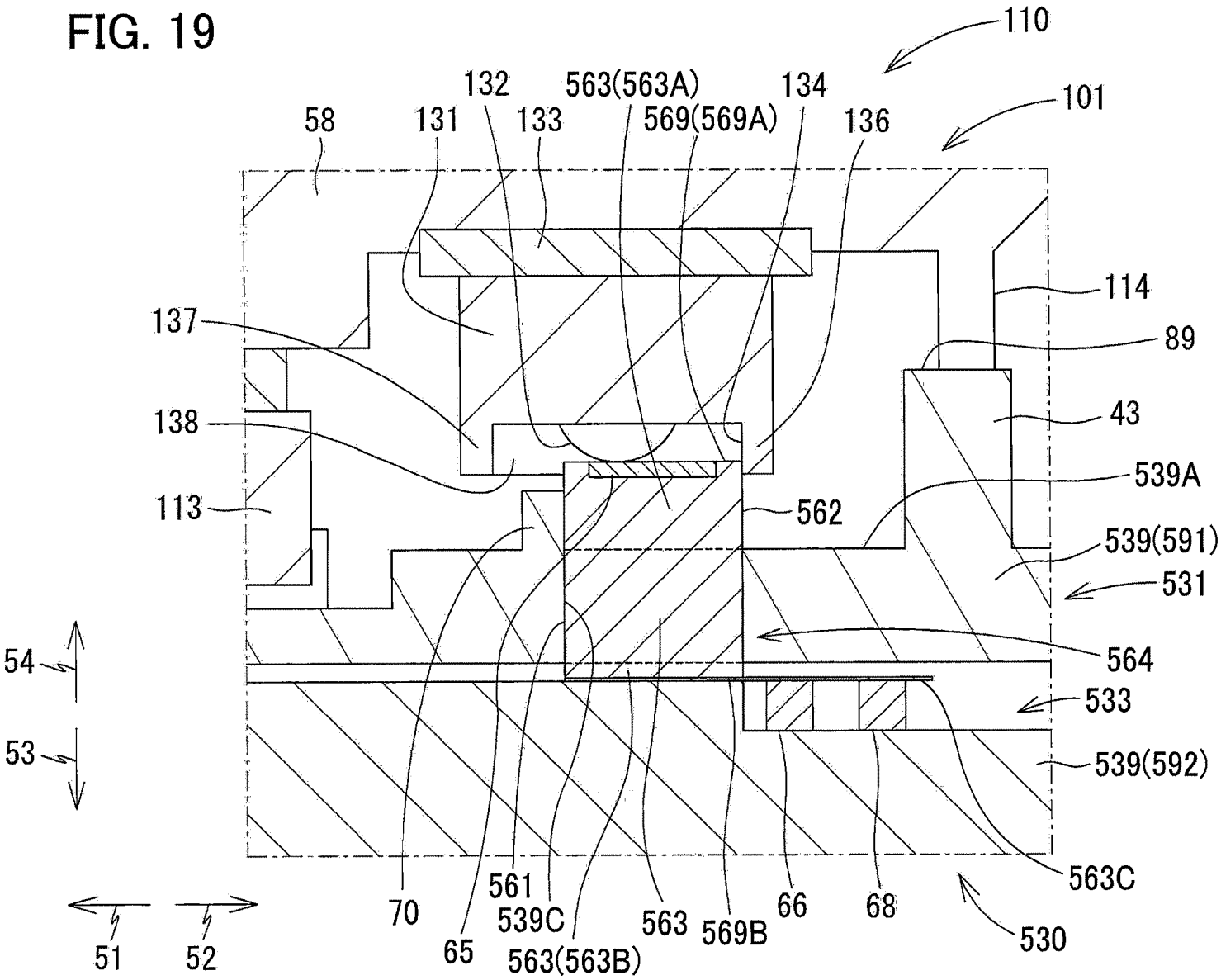
FIG. 19 is an enlarged view of an area corresponding to the area of FIG. 10 in an ink cartridge according to a fourth modification to the embodiment.
Figure 20:
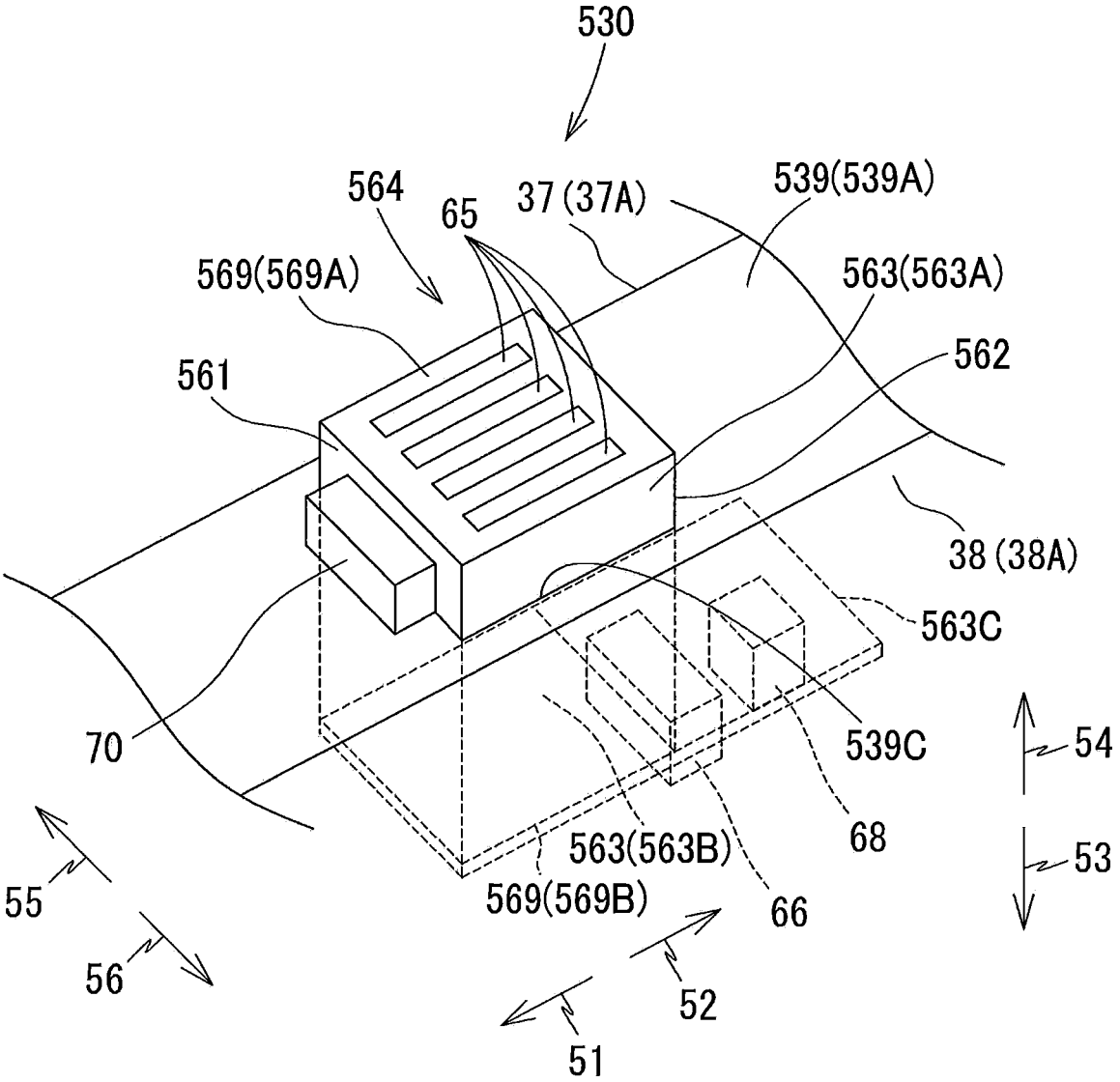
FIG. 20 is a perspective view illustrating a structure in the vicinity of a circuit board of the ink cartridge according to the fourth modification.

FIGS. 19 and 20 illustrate an ink cartridge 530 according to a fourth modification to the embodiment. The ink cartridge 530 includes a housing 531 and a circuit board 564.

As in the third modification, the housing 531 includes a top wall 539 formed with a through-hole 539C. The circuit board 564 is arranged to be inserted in the through-hole 539C. The top wall 539 is configured of a first top wall 591 and a second top wall 592 arranged to be spaced apart from each other in the vertical direction. The first top wall 591 is positioned above the second top wall 592 and exposed to the outside of the housing 531. The through-hole 539C is formed in the first top wall 591. The second top wall 592 has a lower surface defining the upper edge of the storage chamber 32. The first top wall 591 and second top wall 592 define a space 533 therebetween in the vertical direction.

The circuit board 564 includes a rigid substrate 563 and a flexible substrate 563C. The rigid substrate 563 penetrates the first top wall 591 to extend vertically through the through-hole 539C. The electrodes 65 are formed on a top surface 569A (side surface 569) of the rigid substrate 563. That is, the electrodes 65 are supported on an upper portion 563A of the rigid substrate 563 positioned above the first top wall 591 (through-hole 539C). The flexible substrate 563C is affixed to a bottom surface 569B of the rigid substrate 563. Specifically, an upper surface of the flexible substrate 563C is affixed to the bottom surface 569B of the rigid substrate 563. The memory 66 and battery 68 are mounted on a lower surface of the flexible substrate 563C. The flexible substrate 563C is supported by an upper surface of the second top wall 592 from below, the upper surface facing the lower surface of the first top wall 591. In other words, a lower end portion 563B of the rigid substrate 563 (the portion below the through-hole 539C) and the flexible substrate 563C are positioned in the space 533 defined between the first top wall 591 and the second top wall 592.

Incidentally, the memory 66 and battery 68 may not be positioned both on the flexible substrate 563C. For example, at least one of the memory 66 and the battery 68 may be mounted on the rigid substrate 563.

Further, as in the embodiment, the raised portion 70 is provided on the top wall 539 (first top wall 591) at a position frontward of the circuit board 564. The raised portion 70 is in contact with a first surface (front surface) 561 of the substrate 563.

In the attached state of the ink cartridge 530 to the cartridge-attachment portion 110, the rigid substrate 563 (a second surface 562, i.e., a rear surface) is in contact with the rear wall 136 of the connector 130 from frontward thereof, as illustrated in FIG. 19. Alternatively, as in the first modification (see FIG. 13), a protrusion corresponding to the protrusion 271 of the first modification may be provided on the top wall 539 (first top wall 591) at a position rearward of the rigid substrate 563, so that the protrusion can contact the rear wall 136 from frontward thereof in the attached state of the ink cartridge 530.

In the attached state of the ink cartridge 530, components of the cartridge-attachment portion 110 (the connector 130, for example) are located in a space above the top wall 539 (a top surface 539A of the top wall 539). Thus, there is little freedom in arranging the circuit board 564 in the space above the top wall 539. However, a sufficient space can be provided for locating the circuit board 564 below the top wall 539 (first top wall 591). With this structure of the fourth modification, the flexible substrate 563C contributes to substantial enlargement of the circuit board 564.

Fifth Modification

In the fourth modification, the circuit board 564 includes the rigid substrate 563 and the flexible substrate 563C. However, the circuit board may be configured solely of a flexible substrate.

Figure 21:
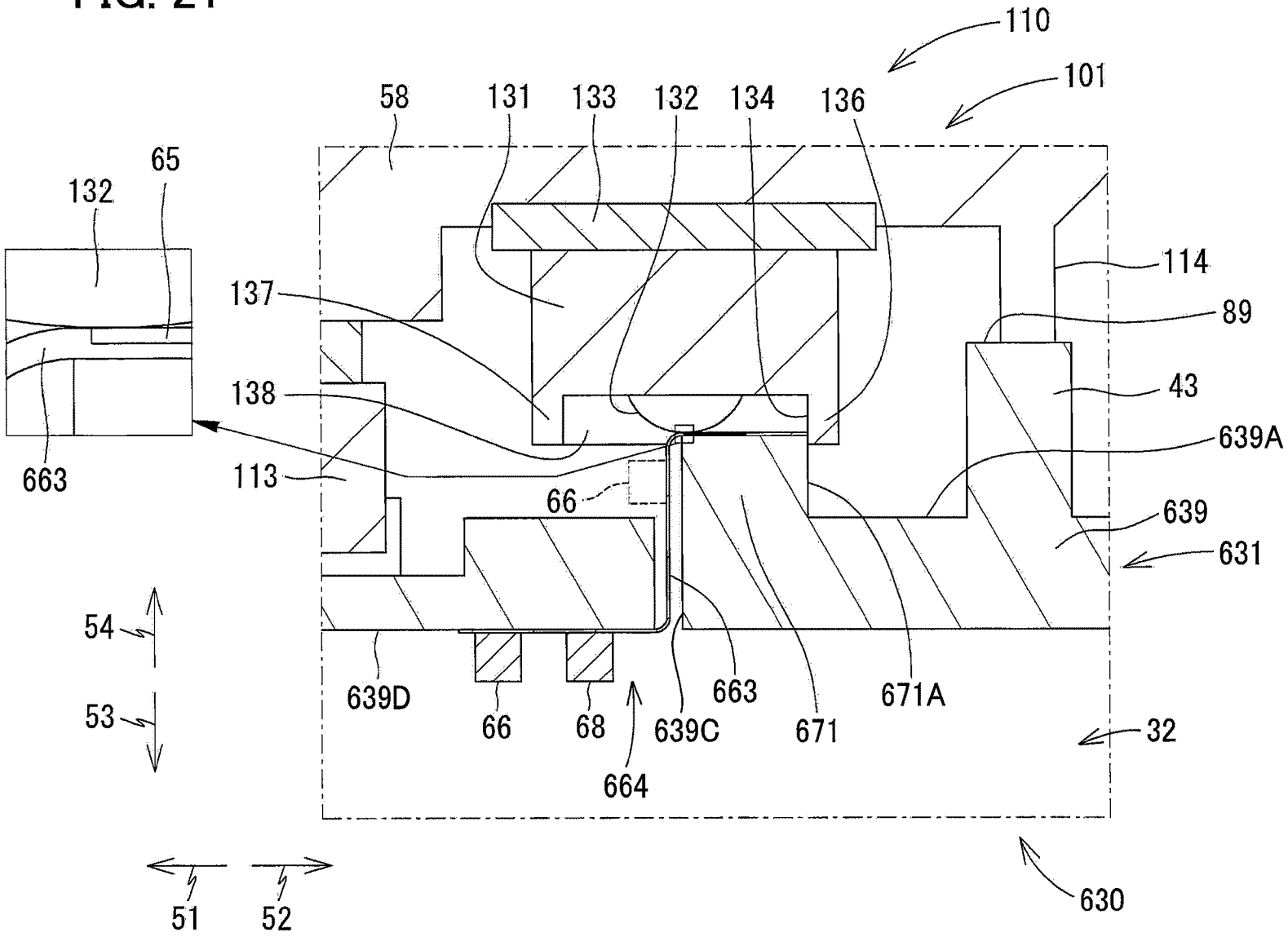
FIG. 21 is an enlarged view of an area corresponding to the area of FIG. 10 in an ink cartridge according to a fifth modification to the embodiment.
Figure 22:
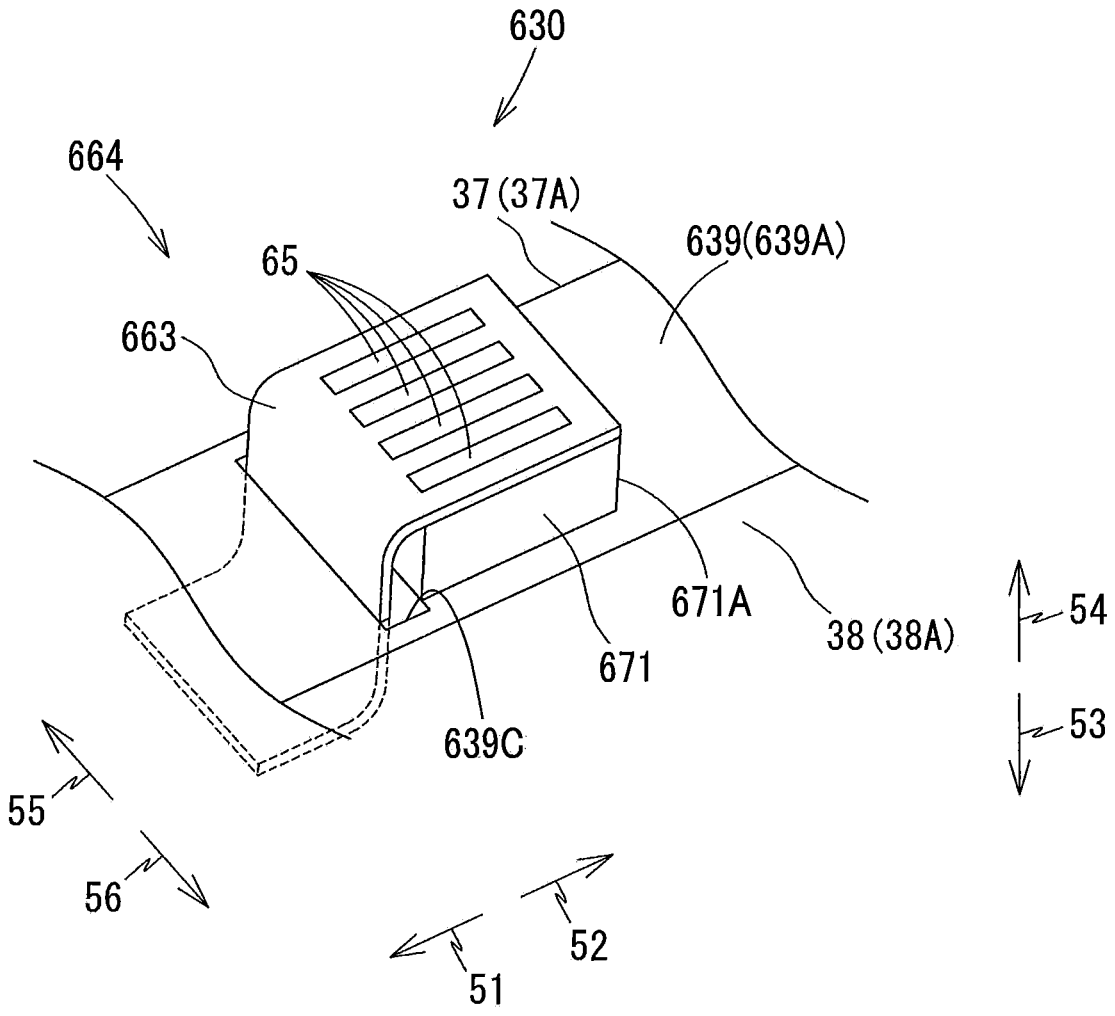
FIG. 22 is a perspective view illustrating a structure in the vicinity of a circuit board of the ink cartridge according to the fifth modification.

As an example, FIGS. 21 and 22 depict an ink cartridge 630 according to a fifth modification to the embodiment. The ink cartridge 630 includes a housing 631 and a circuit board 664. The circuit board 664 includes a flexible substrate 663.

Specifically, the housing 631 includes a top wall 639 formed with a through-hole 639C. The flexible substrate 663 is arranged to be inserted in the through-hole 639C. More specifically, a portion of the flexible substrate 663 above the through-hole 639C is affixed to a protrusion 671 provided on a top surface 639A of the top wall 639. The portion of the substrate 663 exposed upward through the through-hole 639C is thus supported by the protrusion 671. The electrodes 65 are formed the portion fixed to a top surface of the protrusion 671. On the other hand, a portion of the flexible substrate 663 below the through-hole 639C is affixed to a lower surface 639D of the top wall 639. The memory 66 and battery 68 are both mounted on the portion of the substrate 663 positioned below the through-hole 639C. Hence, in FIG. 22, neither the memory 66 nor the battery 68 is visible, since the memory 66 and battery 68 are covered by the top wall 639.

Incidentally, the memory 66 and the battery 68 may be arranged at different positions from those shown in FIG. 21. For example, the memory 66 may be arranged on the substrate 663 at a position indicated by a broken line in FIG. 21.

With this structure, the flexible substrate 663 is arranged to penetrate vertically through the top wall 639 to extend along the top surface 639A of the top wall 639 and along the lower surface 639D of the top wall 639.

In the attached state of the ink cartridge 630, a rear surface 671A of the protrusion 671 is in contact with the rear wall 136 of the connector 130.

[Other Variations]

In the embodiment and modifications described above, the passage 75A (opening 75B) of the cylinder 75 is closed and opened by the valve 79. However, instead of the valve 79, a seal may be used to close the opening 75B, for example.

More specifically, a seal may be affixed to a front surface of the cylinder 75 so as to close the through-hole 76A in the ink cartridge 30 prior to insertion into the cartridge-attachment portion 110. Since the through-hole 76A is sealed by the seal, ink in the storage chamber 32 does not flow out through the through-hole 76A. The seal may be punctured and broken by the tube 102 of the cartridge-attachment portion 110 during the insertion of the ink cartridge 30 into the cartridge-attachment portion 110, thereby opening the through-hole 76A to provide communication between the storage chamber 32 (passage 75A) and the interior space 102A of the tube 102.

In this case, preferably, an urging member for urging the inserted ink cartridge 30 rearward (a coil spring, for example) be provided either at the ink cartridge 30 or at the cartridge-attachment portion 110. Such an urging member can apply a rearward urging force to the ink cartridge 30 in a state where the circuit board 64 (or the protrusion 271) faces the rear wall 136 of the connector 130 of the cartridge-attachment portion 110. Either the circuit board 64 or the protrusion 271 thus contacts the rear wall 136 from frontward thereof to provide positioning of the ink cartridge 30 in the front-rear direction within the cartridge holder 101.

In the depicted embodiment, the ink cartridge 30 is inserted into the cartridge holder 101 and pivoted within the cartridge holder 101 to be attached thereto. However, the ink cartridge 30 may not be pivoted within the cartridge holder 101 during insertion into the cartridge holder 101.

Figure 23:
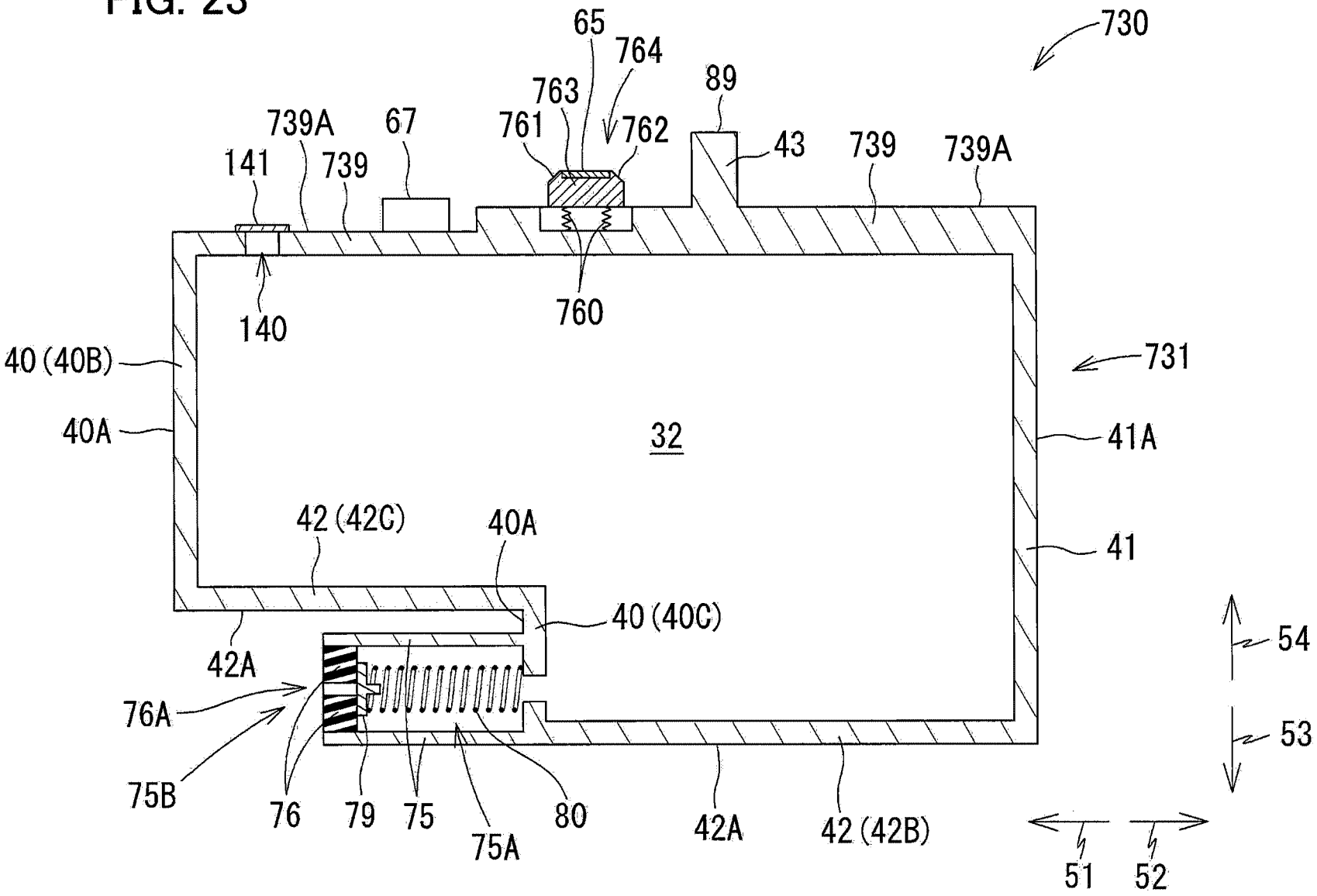
FIG. 23 is a vertical cross-sectional view of an ink cartridge according to a variation of the embodiment.

As an example, FIG. 23 illustrates an ink cartridge 730 according to a variation of the embodiment. The ink cartridge 730 includes a housing 731 and a circuit board 764 movably supported relative to the housing 731. Specifically, the circuit board 764 is urged upward by an urging member 760 (a coil spring, for example) connected to a top wall 739 of the housing 731. The circuit board 764 is therefore movable in the vertical direction relative to the housing 731.

The circuit board 764 includes a substrate 763 having a sloped front surface 761 and a sloped rear surface 762. The front surface 761 slopes downward toward the front, while the rear surface 762 slopes downward toward the rear.

The ink cartridge 730 according to this variation is configured to be inserted and removed horizontally relative to the cartridge-attachment portion 110. During insertion of the ink cartridge 730 into the cartridge-attachment portion 110, the front surface 761 abuts against the rear wall 136 from rearward thereof. This abutment against the rear wall 136 moves the circuit board 764 downward against an urging force of the urging member 760. As the circuit board 764 goes down and moves past the rear wall 136 to come to a position frontward of the rear wall 136, the circuit board 764 is moved upward by the urging force of the urging member 760 such that the electrodes 65 come into contact with the contacts 132 from below.

As the ink cartridge 730 is removed from the cartridge-attachment portion 110, the rear surface 762 of the substrate 763 abuts on the rear wall 136 from frontward thereof. The circuit board 764 is therefore moved downward against the urging force of the urging member 760. As the circuit board 764 goes down and moves past the rear wall 136 to arrive at a location rearward of the rear wall 136, the circuit board 764 is moved upward by the urging force of the urging member 760. In this way, due to the movable configuration of the circuit board 764, the rear wall 136 of the connector 130 does not hinder insertion and removal of the ink cartridge 730 relative to the cartridge-attachment portion 110 in the horizonal direction.

Figure 24:
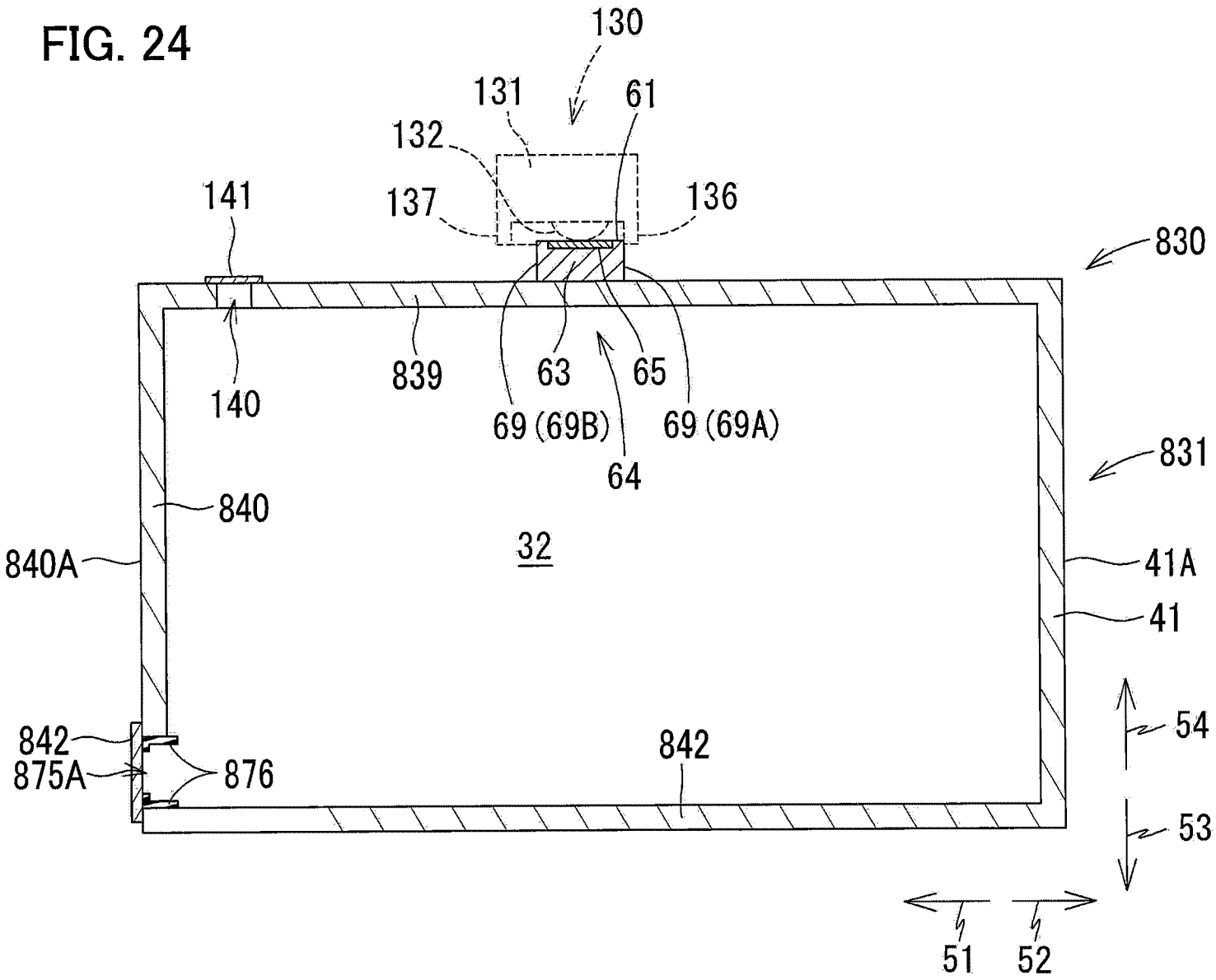
FIG. 24 is a vertical cross-sectional view of an ink cartridge according to another variation of the embodiment.

Still further, the ink cartridge 30 may have a different outline from the depicted embodiment and modifications. FIG. 24 illustrates an ink cartridge 830 according to another variation of the embodiment. The ink cartridge 830 of this variation has a generally rectangular parallelepiped shape (the projection 67, protruding part 43, cylinder 75 and coil spring 80 are dispensed with). Specifically, the ink cartridge 830 includes a housing 831 and the circuit board 64 of the embodiment. The housing 831 includes a top wall 839, a bottom wall 842, a front wall 840 and the rear wall 41. The circuit board 64 of the embodiment is provided on the top wall 839. The front wall 840 is formed with a passage 875A penetrating therethrough in the front-rear direction. A sealing member 876 is fitted in the passage 875A. A seal 842 is provided on a front surface 840A of the front wall 840 to close the passage 875A.

In the depicted embodiment, ink is described as an example of liquid, but the liquid cartridge of the disclosure may store liquid other than ink, such as pretreatment liquid that is ejected onto sheets or the like prior to ink during a printing operation, or water for cleaning the recording head 21.

It should be apparent to those who skilled in the art that the embodiments 1-4, modifications thereto and variations described above may be combined with one another as appropriate.

<Remarks>

The ink cartridges 30, 230, 330, 430, 530, 730 and 830 are an example of a liquid cartridge. The storage chamber 32 is an example of a storage chamber. The passage 75A is an example of a liquid passage. The circuit boards 64, 364, 464, 564, 764 and 864 are examples of a circuit board. The substrates 63, 363, 463 and 563 are examples of a substrate. The rear surfaces 69A, 369A and second surface 562 are examples of a printer engaging surface of the substrate. The upper portions 463A, 563A are examples of a first part. The lower portions 463B, 563B are examples of a second part. The electrodes 65 are an example of an electrical contact. The flexible substrate 563C is an example of a flexible substrate. The memory 66 is an example of a memory. The battery 68 is an example of an electronic component. The top walls 39, 239, 339, 439, 539, 739 and 839 are examples of a top wall. The first top walls 491 and 591 are examples of a first top wall. The second top walls 492 and 592 are examples of a second top wall. The contact member 372 (upper portion 373) and protrusions 271 and 471 are examples of a protrusion. The raised portion 70 is an example of another protrusion. The rear surface 271B of the protrusion 271, the rear surface of the upper portion 373 of the contact member 372, and the rear surface of the protrusion 471 are examples of a printer engaging surface of the protrusion. The through-holes 439C and 539C are examples of a through-hole. The frontward direction 51 is an example of a first lateral direction. The rearward direction 52 is an example of a second lateral direction.

What is claimed is:

1. A liquid cartridge comprising:

a housing defining a storage chamber configured for storing liquid therein;

a liquid passage extending in a first lateral direction from the housing when the housing is in an operational posture, the liquid passage being in communication with the storage chamber; and a circuit board comprising:

a substrate; and an electrical contact provided on the substrate;

a first protrusion protruding upward from the housing, the first protrusion being in contact with the substrate and positioned forward of the electrical contact in the first lateral direction; and a second protrusion protruding upward from the housing, the second protrusion being in contact with the substrate and positioned rearward of the electrical contact in the first lateral direction, the second protrusion having a surface facing in a second lateral direction opposite the first lateral direction.

2. The liquid cartridge according to claim 1, wherein the second protrusion is integral with the housing.

3. The liquid cartridge according to claim 1, wherein the substrate is elongated in a prescribed direction crossing the second lateral direction to provide a rear surface elongated in the prescribed direction and facing in the second lateral direction.

4. The liquid cartridge according to claim 1, wherein the second protrusion is provided as a separate member from the housing, and the second protrusion has a hardness higher than a hardness of the housing.

5. The liquid cartridge according to claim 4, wherein the second protrusion has a solid columnar shape, and wherein the substrate has a rear surface facing in the second lateral direction, the rear surface of the substrate being formed with a recess, the recess being recessed in the first lateral direction to have an arcuate shape in a top view, the second protrusion being in contact with the recess.

6. The liquid cartridge according to claim 1, wherein the housing comprises:

a front wall through which the liquid passage extends;

a rear wall positioned opposite to the front wall with respect to the storage chamber;

a top wall connecting the front wall to the rear wall; and a bottom wall connecting the front wall to the rear wall and positioned opposite to the top wall with respect to the storage chamber, and wherein the circuit board is provided at the top wall.

7. The liquid cartridge according to claim 6, wherein the top wall comprises a first top wall and a second top wall positioned below the first top wall to be spaced apart therefrom, the first top wall being formed with a through-hole through which the circuit board extends, and wherein the circuit board comprises a first part positioned above the first top wall, and a second part positioned below the first top wall.

8. The liquid cartridge according to claim 7, wherein the circuit board further comprises:

a memory; and an electronic component configured to supply electric power to the memory, the electronic component being provided at the second part.

9. The liquid cartridge according to claim 7, wherein the substrate of the circuit board penetrates the first top wall vertically through the through-hole, and wherein the substrate has a bottom surface supported on the second top wall.

10. The liquid cartridge according to claim 9, wherein the circuit board further comprises:

a memory; and an electronic component configured to supply electric power to the memory, the memory and the electronic component being mounted on the substrate in a space defined between the first top wall and the second top wall.

11. The liquid cartridge according to claim 1, wherein the circuit board further comprises a memory mounted on a front surface of the substrate, the front surface facing in the first lateral direction.

12. The liquid cartridge according to claim 1, wherein the second protrusion has a height greater than a height of the first protrusion when the housing is in the operational posture.

13. The liquid cartridge according to claim 1, wherein the substrate is immovable relative to the housing.

14. The liquid cartridge according to claim 1, wherein the second protrusion is provided as a separate member from the housing.

15. The liquid cartridge according to claim 1, wherein the electrical contact is mounted on a top surface of the substrate.

* * * * *